US012612687B2

(12) United States Patent
Park et al.

(10) Patent No.: US 12,612,687 B2
(45) Date of Patent: Apr. 28, 2026

(54) AMORPHOUS ALLOY, MANUFACTURING METHOD THEREOF, AND PRODUCT INCLUDING THE SAME

(71) Applicant: Seoul National University R&DB Foundation, Seoul (KR)

(72) Inventors: Eun Soo Park, Seoul (KR); Geunhee Yoo, Seoul (KR); Wookha Ryu, Seoul (KR); Myeong Jun Lee, Seoul (KR); Ming Kyung Kwak, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 412 days.

(21) Appl. No.: 18/207,563

(22) Filed: Jun. 8, 2023

(65) Prior Publication Data

US 2023/0399730 A1 Dec. 14, 2023

(30) Foreign Application Priority Data

Jun. 9, 2022 (KR) ..... 10-2022-0070405
Feb. 3, 2023 (KR) ..... 10-2023-0015092

(51) Int. Cl.
*C22C 45/10* (2006.01)
*C22C 1/03* (2006.01)
*C22C 1/11* (2023.01)

(52) U.S. Cl.
CPC ..... *C22C 45/10* (2013.01); *C22C 1/03* (2013.01); *C22C 1/11* (2023.01); *C22C 2200/02* (2013.01)

(58) Field of Classification Search
CPC ..... C22C 1/03; C22C 1/11; C22C 2200/02; C22C 45/10
See application file for complete search history.

(56) References Cited

U.S. PATENT DOCUMENTS

2017/0034965 A1* 2/2017 Park ..... C23C 14/34
2019/0112695 A1* 4/2019 Li ..... C22C 1/02
2022/0098713 A1 3/2022 Park et al.
2022/0098714 A1 3/2022 Park et al.

FOREIGN PATENT DOCUMENTS

KR 1020180061358 6/2018
KR 1020190109004 9/2019
KR 1020220042709 4/2022
KR 1020220079518 6/2022
KR 102531083 5/2023

* cited by examiner

*Primary Examiner* — Jie Yang
(74) *Attorney, Agent, or Firm* — CANTOR COLBURN LLP

(57) ABSTRACT

Disclosed are an amorphous alloy, a manufacturing method thereof, and a product including the same. The novel amorphous alloy according to an embodiment includes a quaternary amorphous alloy matrix including Zr, Ni, Cu, and Al; and a complex concentrated alloy (CCA) dispersed inside the quaternary amorphous alloy matrix and including at least two elements selected from Ti, Zr, Hf, V, Nb, Ta, and Mo.

18 Claims, 15 Drawing Sheets

AMORPHOUS ALLOY, MANUFACTURING METHOD THEREOF, AND PRODUCT INCLUDING THE SAME

CROSS-REFERENCE TO RELATED APPLICATION

This application claims priority to and the benefit of Korean Patent Application No. 10-2023-0015092 filed in the Korean Intellectual Property Office on Feb. 3, 2023, and Korean Patent Application No. 10-2022-0070405 filed in the Korean Intellectual Property Office on Jun. 9, 2022, and the entire contents of which are incorporated herein by reference.

BACKGROUND OF THE INVENTION

(a) Field of the Invention

An amorphous alloy, a manufacturing method thereof, and a product including the same are disclosed.

(b) Description of the Related Art

An amorphous alloy is attracting attention as next generation high quality structural materials Specifically, the amorphous alloy is an amorphous solid, in which constituent atoms are not periodically arranged, and has excellent corrosion resistance and formability as well as higher strength and elastic limit than a crystalline alloy.

However, the amorphous alloy exhibits little ductility at room temperature and has low fracture toughness and thus has a limitation in commercialization as structural materials.

In this regard, several attempts to improve the ductility of the amorphous alloy have been made.

For example, various elements are added to control the amorphous structure during a process of manufacturing the amorphous alloy, or after manufacturing the amorphous alloy, strain may be applied thereto to form a shear band or locally dilate the structure.

However, due to essential characteristics of the amorphous structure, the attempts result in very limitedly increasing the ductility but rather sharply deteriorating the material strength in many cases.

Recently, a high entropy alloy and a complex concentrated alloy (CCA) with disordered atomic arrangements of multiple elements in a single crystal lattice structure have been developed.

First of all, the high entropy alloy is an alloy system in which all constituent elements have the same or similar atomic fractions. In other words, all the elements constituting the high entropy alloy act as main elements and cause high mixing entropy. Accordingly, the high entropy alloy forms not an intermetallic compound or an intermediate compound even at a high temperature but a stable solid solution.

CCA is an extended concept from the high entropy alloy. Each substitutional solid solution elements constituting CCA may have a fraction within a wide range of about 5 to about 95 atomic %, and solute elements within a single crystal lattice structure may have close interactions. Accordingly, CCA may exhibit different characteristics from a typical amorphous alloy having a disordered liquid structure in which the solute elements surrounded with matrix elements.

SUMMARY OF THE INVENTION

Further from the concept of CCA, an embodiment provides a novel amorphous alloy in which CCA is added to a quaternary amorphous alloy matrix.

Another embodiment provides a method for manufacturing the novel amorphous alloy.

Another embodiment provides a product including the novel amorphous alloy.

An embodiment provides an amorphous alloy that includes a quaternary amorphous alloy matrix including Zr, Ni, Cu, and Al; and a complex concentrated alloy (CCA) dispersed inside the quaternary amorphous alloy matrix and including at least two elements selected from Ti, Zr, Hf, V, Nb, Ta, and Mo.

Based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance.

The complex concentrated alloy may have a single-phase body-centered cubic (BCC) structure.

A complex quasicrystal cluster dispersed inside the amorphous matrix may be further included.

The complex quasicrystal cluster may include a plurality of quasicrystal nuclei (QC) and a free volume region in which the quasicrystal nuclei do not exist.

Each of the quasicrystal nuclei may include a plurality of principal clusters and an adhesive element (glue atom) for adhering the plurality of principal clusters.

The principal cluster may include Zr and Ni among elements constituting the quaternary amorphous alloy matrix.

Each principal cluster may include Zr and Ni in an atomic ratio of about 1:1 to about 3:1.

The principal cluster may have an icosahedral structure.

For each principal cluster, nine Zr's and three Ni's form a basic framework of the icosahedral structure, and one Ni may be disposed at a center of the basic framework of the icosahedral structure.

The adhesive element (glue atom) may include at least one element of elements constituting the complex concentrated alloy.

The entire composition of the amorphous alloy may be represented by Chemical Formula 1:

$$Zr_aNi_bCu_{c-d}Al_f(X)_d \quad \text{[Chemical Formula 1]}$$

In Chemical Formula 1, X includes two or more elements selected from Ti, Zr, Hf, V, Nb, Ta, and Mo, b is 2 to 29, (c-d) is 2 to 29, d is 1 to 10, f is 6 to 18, and a is 100−(b+c+f).

X in Chemical Formula 1 may satisfy Equation 1:

$$10.0 \leq \{(1/3)*(x+n+o+p)+(1/6.9)*y+(1/7)*(z+m)\} \quad \text{[Equation 1]}$$

In Equation 1, x is an atomic fraction of Ti in Chemical Formula 1; y is an atomic fraction of Zr in Chemical Formula 1; z is an atomic fraction of Hf in Chemical Formula 1; m is an atomic fraction of V in Chemical Formula 1; n is an atomic fraction of Nb in Chemical Formula 1; o is an atomic fraction of Ta in Chemical Formula 1; and p is an atomic fraction of Mo in Chemical Formula 1.

The X may include at least four elements selected from Ti, Zr, Hf, V, Nb, Ta, and Mo.

A supercooled liquid region of the amorphous alloy may be greater than or equal to about 20 K.

The amorphous alloy may have an elongation rate of greater than or equal to about 5% during a three-point bending test on a plate-shaped specimen having a thickness of 1 mm.

The amorphous alloy may have a fracture rate of 0% when a compression test is performed on a specimen having an aspect ratio of greater than or equal to about 1 and less than or equal to about 3.5 until the aspect ratio is 1.

The amorphous alloy may have a fracture toughness of greater than or equal to about 100 $MPa \cdot m^{1/2}$ in a fracture test on a specimen having a thickness of 0.01 to 2.0 mm.

The amorphous alloy may have more than twice increased fatigue life-span after continuously performing a fatigue test and 10 heat repetition processes within the elasticity range for a specimen having a size of 0.01 to 2.0 mm.

The amorphous alloy may have a reduction rate of an enthalpy value of greater than or equal to about 20% after 10 thermal strain cycles on a rod-shaped specimen having a size of 2 mm, when alternately performing an environment of less than or equal to about −50° C. and an environment of greater than or equal to about 100° C. for 20 seconds or longer, respectively, as one thermal strain cycle.

The amorphous alloy may be produced by cooling a molten metal including the first alloying elements and the second alloying elements, and may have a critical cooling rate of greater than or equal to about $10^0$ K/s and less than or equal to about $10^6$ K/s during cooling of the molten metal, and a thickness may be greater than or equal to about 10 μm and less than or equal to about 20 mm.

In another embodiment, a method of manufacturing an amorphous alloy includes a first step of preparing a complex concentrated alloy (CCA) including at least two selected from Ti, Zr, Hf, V, Nb, Ta, and Mo; Zr, Ni, Cu, and A second step of preparing a mixture by mixing Zr, Ni, Cu, and Al with the complex concentrated alloy; a third step of melting the mixture to produce molten metal; and a fourth step of cooling the molten metal obtain an amorphous alloy.

Among a total amount, 100 atomic % of the Zr, Ni, Cu, and Al, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance.

In the fourth step, the critical cooling rate may be greater than or equal to about $10^0$ K/s and less than or equal to about $10^6$ K/s.

In the fourth step, a thickness of the molten metal may be greater than or equal to about 10 μm and less than or equal to about 20 mm.

Another embodiment provides a product including the amorphous alloy.

The product may be a sporting goods, a medical device, a gear of a watch, an interior material of an electronic device, an exterior material of an electronic device, or a driving unit of a smart robot.

In the novel amorphous alloy of an embodiment, CCA is added to a quaternary amorphous alloy matrix to maximize deviation in local composition and deviation in structural complexity at the same time.

Accordingly, the novel amorphous alloy of an embodiment, compared to the conventional amorphous alloy, may have a wide supercooled liquid region, high toughness exceeding the brittleness limit, and unique healing properties.

Furthermore, a product to which the novel amorphous alloy of an embodiment is applied may have significantly improved life-span characteristics while having thermal stability and mechanical stability.

BRIEF DESCRIPTION OF THE DRAWINGS

FIG. 5 is a graph (bottom) showing a relationship between cluster volume and cluster level pressure.

FIG. 6 is graphs (three below) showing a composition ranges in which amorphous formation with a thickness of greater than or equal to about 10 μm is possible at a critical cooling rate of less than or equal to about $10^6$ K/s and proeutectoid phases precipitated during heat treatment.

DETAILED DESCRIPTION OF THE EMBODIMENTS

Figure 1:
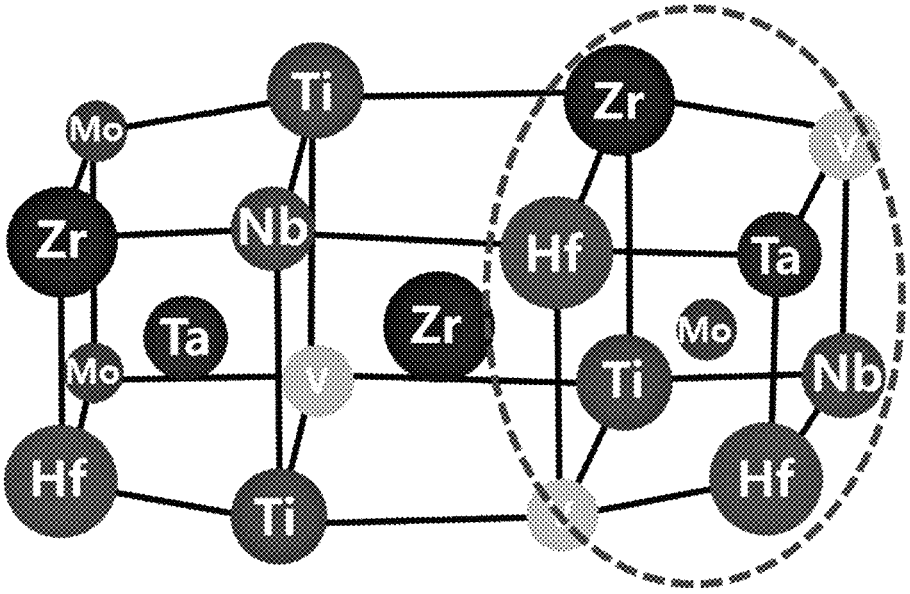
FIG. 1 is a schematic view of a single-phase body-centered cubic (BCC) structure of the complex concentrated alloy.

Hereinafter, specific embodiments will be described in detail so that those skilled in the art can easily implement the same. However, this disclosure may be embodied in many different forms and is not construed as limited to the example embodiments set forth herein.

DEFINITION OF TERMS

The terminology used herein is used to describe embodiments only, and is not intended to limit the present invention. The singular expression includes the plural expression unless the context clearly dictates otherwise.

As used herein, "combination thereof" means a mixture, laminate, composite, copolymer, alloy, blend, reaction product, and the like of the constituents.

Herein, it should be understood that terms such as "comprises," "includes," or "have" are intended to designate the presence of an embodied feature, number, step, element, or a combination thereof, but it does not preclude the possibility of the presence or addition of one or more other features, number, step, element, or a combination thereof.

In the drawings, the thickness of layers, films, panels, regions, etc., are exaggerated for clarity and like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

In addition, "layer" herein includes not only a shape formed on the whole surface when viewed from a plan view, but also a shape formed on a partial surface.

"Thickness" may be measured, for example, through photographs taken with a microscope, such as a scanning electron microscope.

"Atomic %" means the composition ratio of the number of atoms.

"A and/or B" means "A and B, or A or B".

"Bulk" means having a thickness of 1 mm or more or having an amorphous forming ability with a critical cooling rate of less than or equal to about $10^3$ K/s.

(Amorphous Alloy)

An embodiment provides a novel amorphous alloy.

The novel amorphous alloy according to an embodiment includes a quaternary amorphous alloy matrix including Zr, Ni, Cu, and Al, and a complex concentrated alloy (CCA) dispersed inside the quaternary amorphous alloy matrix and including at least two elements selected from Ti, Zr, Hf, V, Nb, Ta, and Mo.

Based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance. Specifically, the Zr may be included in about 55 to about 73 atomic %.

When the above composition range is satisfied, deviation in local composition and deviation in structural complexity may be simultaneously maximized. Accordingly, the novel amorphous alloy of an embodiment, compared to the conventional amorphous alloy, may have a wide supercooled liquid region, high toughness exceeding the brittleness limit, and unique healing properties.

Furthermore, a product to which the novel amorphous alloy of an embodiment is applied may have significantly improved life-span characteristics while having thermal stability and mechanical stability.

Hereinafter, the novel amorphous alloy according to an embodiment is described in more detail.

Complex Concentrated Alloy (CCA)

As previously mentioned, the complex concentrated alloy generally exhibits a single-phase microstructure.

In the novel amorphous alloy of an embodiment, a microstructure of the complex concentrated alloy may be a single-phase body-centered cubic (BCC) structure. FIG. 1 is a schematic view of a single-phase body-centered cubic (BCC) structure of the complex concentrated alloy.

Specifically, in the novel amorphous alloy of an embodiment, the complex concentrated alloy may include 2, 3, 4, 5, 6 or 7 elements selected from Ti, Zr, Hf, V, Nb, Ta, and Mo. A content of elements constituting the complex concentrated alloy may be selected within a wide range of about 5 to about 95 atomic % for each element, and may be selected in an appropriate amount according to the desired characteristics of the final amorphous alloy.

In particular, the number of elements constituting the complex concentrated alloy may be at least two, and as the number of constituent elements increases, properties of the final amorphous alloy may be improved. In particular, when the number of elements constituting the complex concentrated alloy is 4 or more, properties of the final amorphous alloy may be further significantly improved. The characteristics of the final amorphous alloy are as described above or later.

Figure 2:
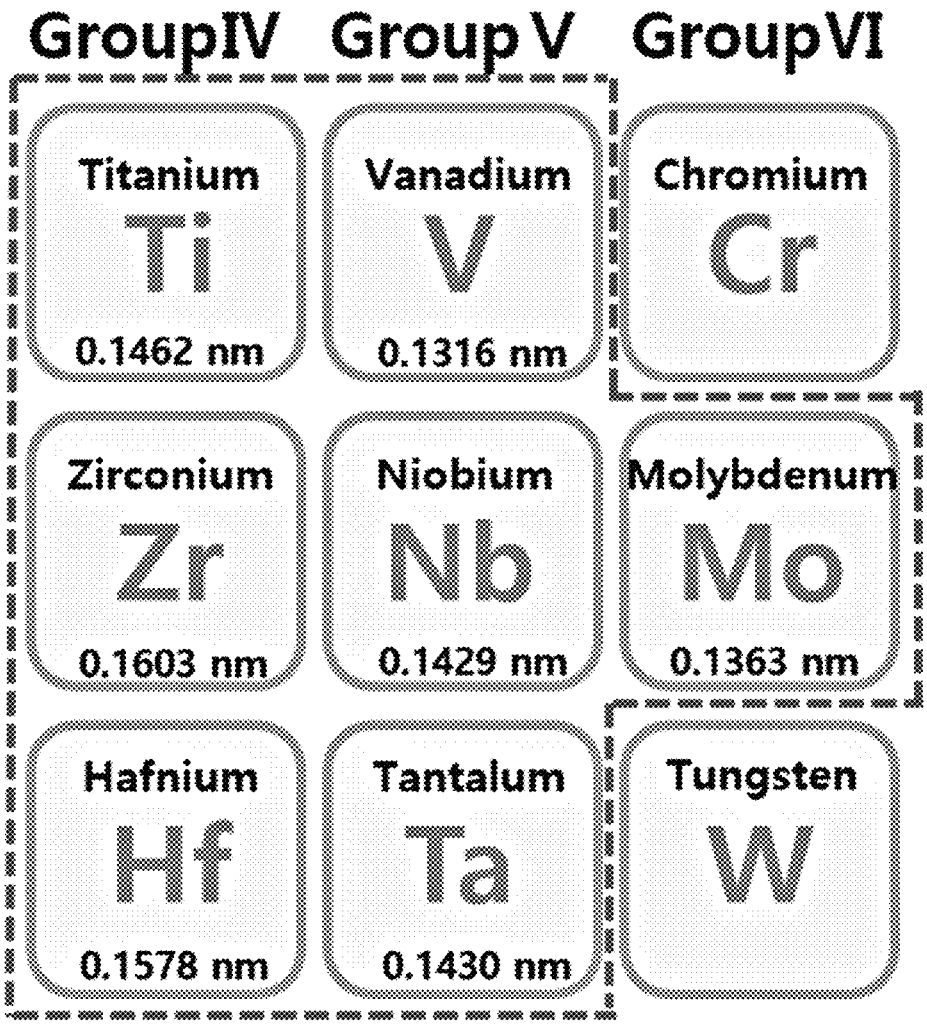
FIG. 2 is a view for explaining a basis for selecting a group of element candidates that may be included in the complex concentrated alloy.

FIG. 2 is a view for explaining a basis for selecting a group of element candidates that may be included in the complex concentrated alloy, and in Table 1, selection results are is summarized. Specifically, the table shows the ratio of Equation A.

100%*{(actual radius of the element candidates)−(ideal atomic radius to be included in the complex concentrated alloy)}/(ideal atomic radius to be included in the complex concentrated alloy) [Equation A]

The ideal atomic radius to be included in the complex concentrated alloy may mean an ideal atomic radius to form a quasicrystal nucleus described later.

For Ti, Zr, Hf, V, Nb, Ta, and Mo, a difference between the radii and the calculated value calculated through Equation A is within the range of −10 to +10%. In particular, the ideal atomic radius corresponds to 0.1445 nm, which corresponds to 90.2% of the radius of Zr element. In addition, in the complex concentrated alloy, elements having a similar heat of mixing relationship within the range of −10 to 10 kJ/mol may be combined with each other in order to promote concentration in the crystal lattice.

Depending on the difference in radii and the similar heat of mixing relationship, the complex concentrated alloy may form a single-phase body-centered cubic structure, while bonding a plurality of principal clusters in an amorphous alloy, quasicrystal nuclei including the plurality of principal clusters and complex quasicrystal clusters may be easily formed.

In particular, in the case of adding the complex concentrated alloy to the quaternary amorphous alloy matrix, compared to the case where individual elements are added, the elements are smoothly dissolved despite the addition of multiple elements, and a homogeneous amorphous structure is formed without forming separate precipitates or segregating.

Furthermore, in the case of adding the complex concentrated alloy to the quaternary amorphous alloy matrix, types and/or numbers of elements that can be added may increase compared to the case of adding individual elements. Here, when the types and/or numbers of elements that can be added increases, complex quasicrystal clusters are created in the amorphous alloy and its structural complexity increases, resulting in comprehensively improving thermoplastic formability, toughness against compressive stress, toughness against tensile stress.

Detailed descriptions of the principal cluster, the complex quasicrystal cluster, and the like will be described later.

TABLE 1

| Complex concentrated alloy Group of element candidates | Atomic radius (nm) | Equation A |
|---|---|---|
| V | 0.1316 | −9.0% |
| Mo | 0.1362 | −5.8% |
| Nb | 0.1429 | −1.2% |
| Ta | 0.1430 | −1.0% |
| Ti | 0.1462 | 1.0% |
| Hf | 0.1577 | 9.0% |
| Zr | 0.1603 | 10.0% |

Complex Quasicrystal Cluster

The novel amorphous alloy of an embodiment may further include a complex quasicrystal cluster dispersed in the quaternary amorphous alloy matrix. This is due to the inclusion of the quaternary amorphous alloy matrix and the complex concentrated alloy.

Figure 3:
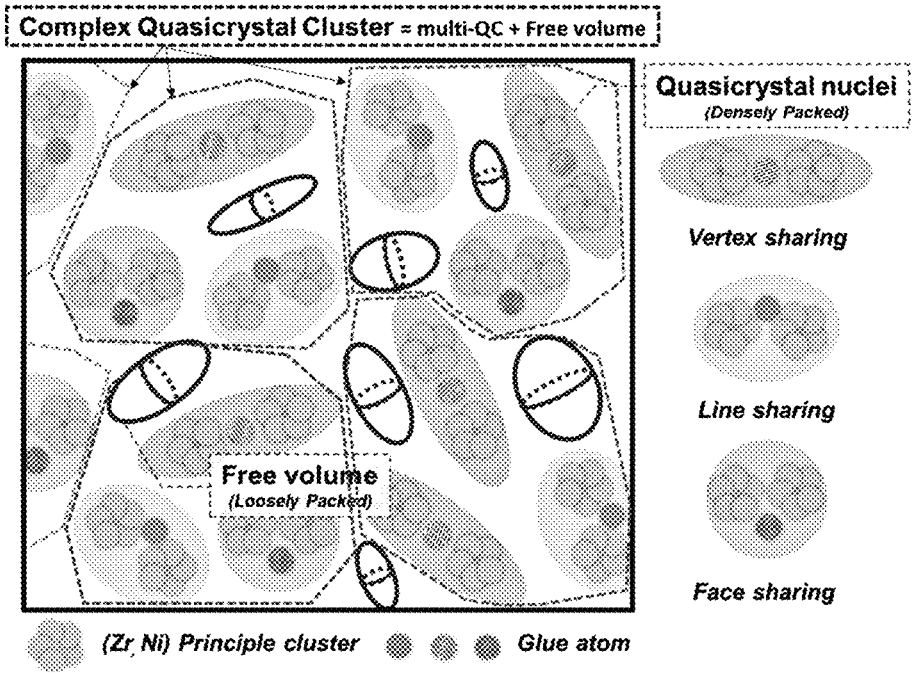
FIG. 3 is a schematic view showing the complex quasicrystal cluster.
Figure 4:
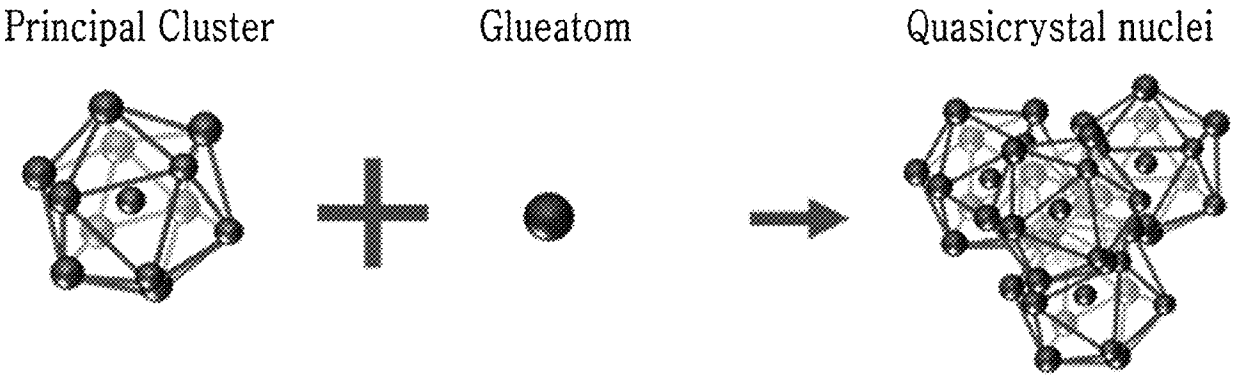
FIG. 4 is a schematic view showing a formation of a quasicrystal nucleus through a bonding of the adhesive element and the principal cluster of the icosahedral structure.

FIG. 3 is a schematic view showing the complex quasicrystal cluster, and FIG. 4 is a schematic view showing the formation of a quasicrystal nucleus through the bonding of the principal cluster of the icosahedral structure and the adhesive element. Hereinafter, the complex quasicrystal cluster will be described with reference to FIGS. 3 and 4.

First, the complex quasicrystal cluster is described from top to bottom as follows.

The complex quasicrystal cluster may include a plurality of quasicrystal nuclei (QC, a plurality of multi-QC) and a free volume region that is a region in which the quasicrystal nuclei do not exist.

The quasicrystal nuclei may be formed by combining principal clusters in the form of vertex sharing, line sharing, or face sharing, and is a region in which constituent atoms are relatively densely packed. In contrast, the free volume region means a region in which the quasicrystal nuclei do not exist, and mainly appears in a region in which constituent atoms are relatively loosely packed.

Specifically, each quasicrystal nuclei may include a plurality of principal clusters and an adhesive element (glue atom) for adhering the plurality of principal clusters. As shown in FIG. 3, the quasicrystal nuclei may be formed by combining the plurality of principal clusters and the adhesive element in a form of vertex sharing, line sharing, or face sharing according to a method of combining the plurality of principal clusters and the adhesive element.

More specifically, the principal cluster may include Zr and Ni among elements constituting the quaternary amorphous alloy matrix. An icosahedral structure may be formed by including Zr and Ni in an atomic ratio of 1:1 to 3:1 per principal cluster. When the atomic ratio of Zr and Ni per principal cluster satisfies the above range, a shape and a size of the bond of the principal cluster can be adjusted, and the complex quasicrystal cluster can be easily formed by easily connecting the principal clusters by the complex and high-temperature alloy.

More specifically, for each principal cluster of the icosahedral structure, nine Zr's and three Ni's form the basic framework of the icosahedral structure (located at vertices); and one Ni may be located at the center of the basic framework of the icosahedral structure.

Meanwhile, the adhesive element may include at least one of the elements constituting the complex concentrated alloy. Different principal clusters may include different adhesive elements.

The bottom to top description of the complex quasicrystal cluster is as follows.

Inside the quaternary amorphous alloy matrix, Zr and Ni may form a principal cluster of an icosahedral structure. At least one of the elements constituting the complex concentrated alloy can function as an adhesive element to adhere the plurality of principal clusters. Accordingly, the plurality of principal clusters and the adhesive element may form quasicrystal nuclei.

Specifically, a plurality of quasicrystal nuclei are aggregated to form the complex quasicrystal cluster, and a free volume region that is a region in which the quasicrystal nuclei do not exist inside the complex quasicrystal cluster.

Descriptions other than this are in common with the above top to bottom description.

The structure of the complex quasicrystal cluster may serve as a 'basic unit' in the novel amorphous alloy of an embodiment, and specifically, a 'basic unit of transformation' such as a shear transformation zone upon strain by application of external energy.

Figure 5:
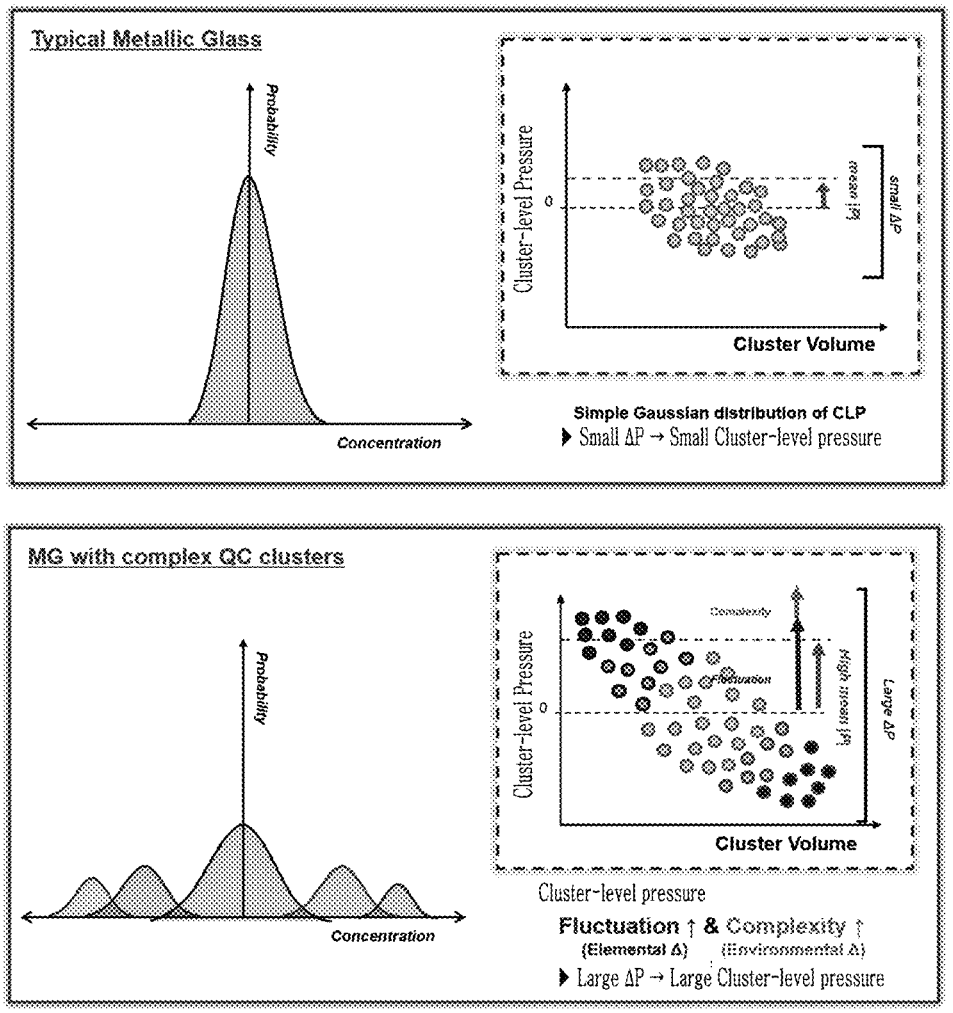
FIG. 5 is a graph (top) showing a relationship between cluster volume and cluster level pressure of a conventional amorphous alloy, and when the complex quasicrystal cluster exists in the novel amorphous alloy of an embodiment.

FIG. 5 is a graph (top) showing a relationship between cluster volume and cluster level pressure of a conventional amorphous alloy; and when the complex quasicrystal cluster exists in the novel amorphous alloy of an embodiment, it is a graph (bottom) showing a relationship between cluster volume and cluster level pressure.

Herein, "cluster level pressure" means a pressure generated due to misfit between the 'cluster' and the 'cluster periphery.'

This is due to a difference in volume and stiffness caused by the structural diversity of the 'cluster.'

Referring to FIG. 5, unlike the conventional amorphous alloy, when the complex quasicrystal cluster exists in the novel amorphous alloy of an embodiment, a dispersion and complexity of the cluster level pressure increase.

As a result, in the novel amorphous alloy of an embodiment, a total deviation of the level pressure between the complex quasicrystal clusters increases, and the stress is effectively distributed when stress is applied, so that a uniform strain limit stress is significantly increased, an activation energy of shear strain increases, and a total strain induced inside increases relatively when external energy is applied, resulting in unique self-healing properties while exhibiting high toughness characteristics even in bulk amorphous materials of 1 mm or more.

A more detailed description of the physical properties exhibited by the novel amorphous alloy of an embodiment will be described later.

Entire Composition of Amorphous Alloy

Basically, out of 100 atomic % of the total amount of the quaternary amorphous alloy matrix, an Al content is greater than or equal to about 6 atomic % and less than or equal to about 18 atomic %. Within this range, the excellent amorphous forming ability can be controlled to be realized, and if the content is out of the above range, the amorphous forming ability may be rapidly deteriorated.

Figure 6:
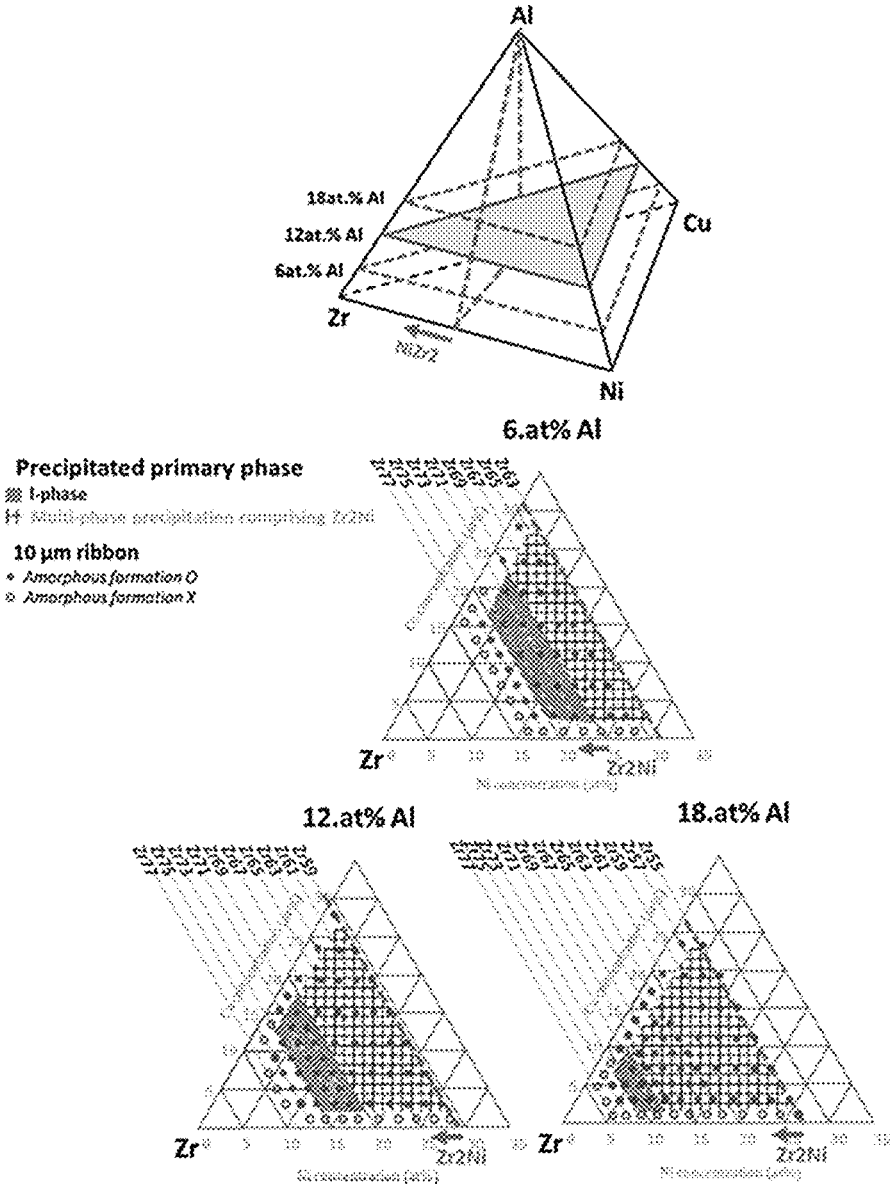
FIG. 6 is a Zr—Ni—Cu—Al quaternary phase diagram showing a plane in which an Al content is constant in the quaternary amorphous alloy matrix, and a cross-section in which the Al content is 6 atomic %, 12 atomic %, or 18 atomic %, respectively indicated (top). In addition, in the Zr—Ni—Cu—Al quaternary phase diagram, for the phase diagram of the Zr-enriched region of the cross-section in which the Al content is 6 atomic %, 12 atomic %, or 18 atomic %, respectively.

FIG. 6 is a Zr—Ni—Cu—Al quaternary phase diagram showing a plane in which an Al content is constant in the quaternary amorphous alloy matrix, and a cross-section in which the Al content is 6 atomic %, 12 atomic %, or 18 atomic %, respectively indicated (top). In addition, in the Zr—Ni—Cu—Al quaternary phase diagram, for the phase diagram of the Zr-enriched region of the cross-section in which the Al content is 6 atomic %, 12 atomic %, or 18 atomic %, respectively, FIG. 6 is graphs (three below) showing a composition ranges in which amorphous formation with a thickness of greater than or equal to about 10 μm is possible at a critical cooling rate of less than or equal to about $10^6$ K/s and proeutectoid phases precipitated during heat treatment. According to the drawing, as described above, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance.

A detailed description of FIG. 6 will be described later.

Considering FIG. 6 above, the novel amorphous alloy of an embodiment may have its entire composition represented by Chemical Formula 1:

$$Zr_aNi_bCu_{c-d}Al_f(X)_d \quad \text{[Chemical Formula 1]}$$

In Chemical Formula 1, X includes two or more elements selected from Ti, Zr, Hf, V, Nb, Ta, and Mo, a content of each element is 5 to 95 atomic %; b is 2 to 29 atomic %; (c-d) is 2 to 29 atomic %; d is 1 to 10 atomic %; f is 6 to 18 atomic %; and a is 100−(b+c+f)

In Chemical Formula 1, the '$Zr_aNi_bCu_{c-d}Al_f$' portion may be due to the quaternary amorphous alloy matrix, and the '$X_d$' portion may be due to the complex concentrated alloy.

Specifically, X in Chemical Formula 1 may satisfy Equation 1:

$$10.0 \leq \{(1/3)*(x+n+o+p)+(1/6.9)*y+(1/7)*(z+m)\} \quad \text{[Equation 1]}$$

In Equation 1, x is an atomic fraction of Ti in Chemical Formula 1; y is an atomic fraction of Zr in Chemical Formula 1; z is an atomic fraction of Hf in Chemical Formula 1; m is an atomic fraction of V in Chemical Formula 1; n is an atomic fraction of Nb in Chemical Formula 1; o is an atomic fraction of Ta in Chemical Formula 1; and p is an atomic fraction of Mo in Chemical Formula 1.

When the complex concentrated alloy satisfies Equation 1, a total distribution of level pressure between the complex quasicrystal clusters is maximized, and thus thermal stability and mechanical stability of the novel amorphous alloy of an embodiment can be greatly improved.

More specifically, the X may include four or more elements selected from Ti, Zr, Hf, V, Nb, Ta, and Mo.

Accordingly, the novel amorphous alloy of an embodiment may be an alloy of 8 or more elements in total, and structural complexity and chemical complexity are maximized through a high entropy effect by a large increase in constitutional entropy, and thus it can exhibit more improved self-healing properties while exhibiting ultra-high toughness characteristics as well as thermal stability.

Properties of Amorphous Alloys

In the novel amorphous alloy of an embodiment, the supercooled liquid region may be greater than or equal to about 20 K, and the upper limit may be less than or equal to about 200 K, although not particularly limited.

Specifically, as the structure of the novel amorphous alloy of an embodiment is complicated compared to the conventional amorphous alloy, crystallization behavior may be delayed. Accordingly, the novel amorphous alloy of an embodiment may have a wide supercooled liquid region of greater than or equal to about 20 K between a glass transition temperature and a crystallization temperature, and may exhibit excellent thermal stability and thermoplastic formability.

In particular, the structural complexity exhibited by the novel amorphous alloy of the embodiment may be due to an existence of the complex quasicrystal cluster.

The novel amorphous alloy of an embodiment may have an elongation rate of greater than or equal to about 5% during a three-point bending test on a plate-shaped specimen having a thickness of 1 mm, and the upper limit may be less than or equal to about 50%, although not particularly limited.

Specifically, the novel amorphous alloy of an embodiment may exhibit high toughness and improved mechanical stability compared to conventional amorphous alloys. Accordingly, when the novel amorphous alloy of an embodiment and the conventional amorphous alloy are subjected to a bending test under the same conditions, the former may have a higher elongation than the latter.

The novel amorphous alloy of an embodiment may have a fracture rate of 0% when a compression test is performed on a specimen having an aspect ratio of greater than or equal to about 1 and less than or equal to about 3.5 until the aspect ratio is 1. If the aspect ratio is less than about 1, it is a ratio in which compression fracture does not occur geometrically, and if it is greater than about 3.5, buckling occurs and is excluded from the above range.

Specifically, in the case of an amorphous alloy in which a strain of 50% has occurred in a rod-shaped specimen having an aspect ratio of greater than or equal to about 1 and less than or equal to about 3.5, specifically about 2 to about 3, more specifically about 2 to about 3, for example about 2 (4 mm height in the case of a 2 mm-sized rod); an aspect ratio after 50% strain approaches 1. Specifically, in the case of an amorphous alloy in which a strain of 50% has occurred in a rod-shaped specimen having an aspect ratio of 1 or more and 3.5 or less (4 mm height in the case of a 2 mm-sized rod); The aspect ratio after 50% strain approaches 1.

For example, in the novel amorphous alloy of an embodiment, when a 50% compression strain test is performed on a rod-shaped specimen having a size of 2 mm, compression fracture does not occur, and the fracture rate may be 0%.

As such, the novel amorphous alloy of an embodiment has superplastic behavior similar to that of the crystalline alloy, and can exhibit improved mechanical stability compared to the conventional amorphous alloy. Accordingly, when the novel amorphous alloy according to an embodiment and a conventional amorphous alloy are tested with respect to compression strain under the same condition, the former has much higher uniform strain limit stress than the latter and no compression fracture itself (a fracture rate of about 0%).

Particularly, the superplasticity behavior of the novel amorphous alloy of an embodiment, in which the complex quasicrystal clusters exist, may be caused by an increase in a total deviation of level pressures between the different complex quasicrystal clusters.

The novel amorphous alloy of an embodiment, when a specimen with a thickness of about 0.01 to about 20.0 mm and specifically, about 0.3 mm is tested, has a fracture toughness of about 100 $MPa \cdot m^{1/2}$ or more, wherein an upper limit thereof may not be particularly limited but about 300 $MPa \cdot m^{1/2}$.

The novel amorphous alloy of an embodiment may exhibit unique self-healing properties of recovering a strain region to which external energy including one selected from a group consisting of mechanical energy, electrical energy, thermal energy, magnetic energy, and a combination thereof is applied.

As such, the novel amorphous alloy of an embodiment may effectively recover its original properties through unique self-healing due to a relative increase of a total strain caused internally when the external energy is applied and thus achieve a longer life-span than a conventional amorphous alloy.

Specifically, the novel amorphous alloy of an embodiment may exhibit an increase in a fatigue life-span by about 2 times or more after performing a fatigue test and ten continuous heat repetition processes with a specimen with a size of about 0.01 mm to about 20.0 mm within the elastic range.

The heat repetition process may be performed as one heat strain cycle of alternating an environment of about −50° C. or less and another environment of about 100° C. or more respectively for about 20 seconds or more.

The elasticity range of the amorphous alloy specimen may be about 2% or so, and the 'fatigue life-span' may mean 'the number of fatigue failure cycles when the amorphous alloy finally reaches a fracture due to propagation of fatigue cracks.'

For example, after the ten heat strain cycles, a rod-shaped specimen having a size of about 2 mm may exhibit an enthalpy reduction rate of about 20% or more (specifically, healing for permanent strain), wherein an upper limit thereof may not be particularly limited but about 100% or less.

The reduction rate of an enthalpy value may be calculated by Equation 2.

Enthalpy reduction rate (%)=100*((enthalpy of amorphous alloy immediately after strain−enthalpy of amorphous alloy after thermal strain cycle after the strain)/(enthalpy of amorphous alloy immediately after strain−enthalpy of amorphous alloy immediately after manufacture)) [Equation 2]

In particular, the self-healing behavior exhibited by the novel amorphous alloy of an embodiment may be attributed to the complex quasicrystal clusters therein. Even when the local strain caused by formation of shear bands extends to a firing strain region in the novel amorphous alloy of an embodiment, viscous flow resistance of quasicrystal nuclei in the complex quasicrystal clusters increases, thereby increasing the total deviation of level pressures between the complex quasicrystal clusters and resultantly, delaying fractures.

Manufacturing Method

The novel amorphous alloy of an embodiment may be prepared by cooling a molten metal including the first alloying elements and the second alloying elements, and a critical cooling rate during the cooling and a thickness of the molten metal are controlled within each specific range, so that the novel amorphous alloy may include the complex quasicrystal clusters.

Herein, "the thickness of the molten metal" may mean the smallest thickness in a three-dimensional shape formed by the molten metal. Specifically, in the three-dimensional shape formed by the molten metal, "the thickness of the molten metal" may mean the shortest distance among distances between a straight line passing though the inside of the three-dimensional shape and an outer surface thereof.

Referring to FIG. 6, in the manufacturing process of the novel amorphous alloy pf an embodiment, the cooling process of the molten metal will be described in detail.

When the molten metal is cooled, the critical cooling rate may be greater than or equal to about $10^0$ K/s and less than or equal to about $10^6$ K/s, and the thickness of the molten metal may be greater than or equal to about 10 μm and less than or equal to about 20 mm.

Herein, the composition of the quaternary amorphous alloy matrix (based on a total amount of 100 atomic % of the quaternary amorphous alloy matrix, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance) is satisfied, a thickness of the molten metal may be controlled to be greater than or equal to about 10 μm and less than or equal to about 20 mm, and the critical cooling rate during cooling of the molten metal may be controlled within the range of greater than or equal to about $10^0$ K/s and less than or equal to about $10^6$ K/s.

Furthermore, in cooling the molten metal, when the critical cooling rate and the thickness of the molten metal satisfy each above range, the novel amorphous alloy including the quaternary amorphous alloy matrix and the complex concentrated alloy dispersed therein may be obtained.

A detailed description of the preparation method will be described later.

(Method of Manufacturing Amorphous Alloy)

Another embodiment provides a method for manufacturing the novel amorphous alloy of the aforementioned embodiment.

Specifically, an embodiment provides a method of manufacturing a novel amorphous alloy which includes a first step of preparing a complex concentrated alloy (CCA) including at least two selected from Ti, Zr, Hf, V, Nb, Ta, and Mo; Zr, Ni, Cu, and A second step of preparing a mixture by mixing Zr, Ni, Cu, and Al with the complex concentrated alloy; a third step of melting the mixture to produce molten metal; and a fourth step of cooling the molten metal obtain an amorphous alloy.

Among a total amount, 100 atomic % of the Zr, Ni, Cu, and Al, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance.

First, the complex concentrated alloy having the above composition is prepared (first step), elements that are raw materials for the quaternary amorphous alloy matrix are added (second step), and the mixture is melted to prepare a molten metal (third step), the molten metal is by finally cooled (fourth step), and thereby a novel amorphous alloy can be manufactured.

Hereinafter, descriptions overlapping with those described above will be omitted, and each step of manufacturing the novel amorphous alloy in an embodiment will be described in detail.

Preparation Step of Complex Concentrated Alloy (First Step)

First, an alloy for complex over-use is prepared by including two or more elements selected from Ti, Zr, Hf, V, Nb, Ta, and Mo. Specifically, a complex concentrated alloy is prepared by including 2, 3, 4, 5, 6, or 7 elements selected from the above group.

In the manufacture of the complex concentrated alloy, depending on characteristics of a desired final amorphous alloy, each element content may be determined within a wide range of about 5 to about 95 element %, in which interactions of solute elements are activated.

As described above, the number of elements constituting the complex concentrated alloy may be at least about two, and as the number of the constituent elements increases, the characteristics of the final amorphous alloy may be improved. In particular, when the number of elements constituting the complex concentrated alloy is at least four, the characteristics of the final amorphous alloy may be significantly more improved. The characteristics of the final amorphous alloy are as described above or below.

Mixing Step (Second Step)

After the first step, a mixture is prepared by mixing the elements (i.e., Zr, Ni, Cu, and Al), which are raw materials of the quaternary amorphous alloy matrix, and complex concentrated alloy.

When preparing the mixture, the stoichiometric atomic ratio may be determined according to the composition of the final target amorphous alloy.

Manufacturing Step of Molten Metal (Third Step)

After the second step, the mixture is melted to prepare a molten metal.

Specifically, the melting temperature range may be about 500 to about 3500° C., and the time may be greater than or equal to about 1 second and less than or equal to about 1 hour.

Cooling Step (Fourth Step)

After the third step, the molten metal is cooled.

In the fourth step, an amorphous alloy including the quaternary amorphous alloy matrix and the complex concentrated alloy may be formed.

Specifically, in the fourth step, a plurality of principal clusters may be formed, and the adhesive element may adhere the plurality of principal clusters to form quasicrystal nuclei. Since this process is performed in a quenching process and the quasicrystal nuclei serve as a seed for crystallization, the quasicrystal nuclei may be referred to as 'quenched nuclei.'

In the fourth step, in particular, the critical cooling rate is greater than or equal to about $10^0$ K/s and less than or equal to about $10^6$ K/s; and a thickness of the molten metal may be greater than or equal to about 10 μm and less than or equal to about 20 mm. When these ranges are satisfied, the complex quasicrystal cluster including a plurality of quasicrystal nuclei and a free volume region, which is a region in which quasicrystal nuclei do not exist, may be formed.

(Product)

Another embodiment provides a product including the novel amorphous alloy of the aforementioned embodiment.

A product to which the novel amorphous alloy of an embodiment is applied may have significantly improved life-span characteristics while having thermal stability and mechanical stability.

The product may be a sporting goods, a medical device, a gear of a watch, an interior material of an electronic device, an exterior material of an electronic device, or a driving unit of a smart robot. However, this is only an example and can be applied to more diverse products.

Hereinafter, examples of the present invention and comparative examples are described. The following examples are only examples of the present invention, but the present invention is not limited to the following examples.

EXPERIMENTAL EXAMPLES

Experimental Example 1: XRD after Casting a Quaternary Ribbon Amorphous Alloy and after First Crystallization After fixing an Al content respectively to 6 atomic %, 12 atomic %, or 18 atomic %, each content of Ni and Cu was changed as shown in Table 2, and Zr was used as a balance, preparing a quaternary amorphous alloy raw material mixture including Zr, Ni, Cu, and Al.

The quaternary amorphous alloy raw material mixture was melted at 2000° C. for 10 minutes, preparing a molten metal. The molten metal was cooled at $10^{6°}$ C./s for 1 second or less and then, formed into a ribbon shape of 10 μm, obtaining a quaternary amorphous alloy specimen.

An X-ray diffraction analyzer (New D8 Advance, Bruker Corporation) was used to analyze a structure of the obtained specimen and thus determine whether or not crystalline phases were precipitated inside the quaternary amorphous alloy specimen and particularly, analyze the primary phases and thus determine whether or not $Zr_2Ni$ phases or quasicrystal phases (icosahedral phases (I-phases)) were formed, and the results are shown in FIG. 6 and Table 2.

TABLE 2

| Composition | 10 μm ribbon amorphous formation | Primary phase |
|---|---|---|
| Zr65Ni28Cu1Al6 | X | — |
| Zr65Ni26Cu3Al6 | ○ | Zr2Ni, ZrAl, Zr2Cu |
| Zr65Ni21Cu7Al6 | ○ | Zr2Ni, ZrAl, Zr2Cu |
| Zr65Ni18Cu11Al6 | ○ | Zr2Ni, ZrAl, Zr2Cu |
| Zr65Ni14Cu15Al6 | ○ | Zr2Ni, ZrAl, Zr2Cu |
| Zr65Ni10Cu19Al6 | ○ | Zr2Ni, ZrAl, Zr2Cu |
| Zr65Ni6Cu23Al6 | ○ | Zr2Ni, ZrAl, Zr2Cu |
| Zr65Ni1Cu28Al6 | ○ | Zr2Cu |
| Zr67Ni26Cu1Al6 | X | — |
| Zr67Ni24Cu3Al6 | ○ | Zr2Ni, ZrAl, Zr2Cu |
| Zr67Ni20Cu7Al6 | ○ | Zr2Ni, ZrAl, Zr2Cu |
| Zr67Ni16Cu11Al6 | ○ | Zr2Ni, ZrAl, Zr2Cu |
| Zr67Ni12Cu15Al6 | ○ | Zr2Ni, ZrAl, Zr2Cu |
| Zr67Ni8Cu19Al6 | ○ | Zr2Ni, ZrAl, Zr2Cu |
| Zr67Ni4Cu23Al6 | ○ | Zr2Ni, ZrAl, Zr2Cu |
| Zr69Ni24Cu1Al6 | X | — |
| Zr69Ni22Cu3Al6 | ○ | Zr2Ni, ZrAl, Zr2Cu |
| Zr69Ni18Cu7Al6 | ○ | Zr2Ni, ZrAl, Zr2Cu |
| Zr69Ni14Cu11Al6 | ○ | Zr2Ni, ZrAl, Zr2Cu |
| Zr69Ni10Cu15Al6 | ○ | Zr2Ni, ZrAl, Zr2Cu |
| Zr69Ni6Cu19Al6 | ○ | Zr2Ni, ZrAl, Zr2Cu |

TABLE 2-continued

| Composition | 10 μm ribbon amorphous formation | Primary phase |
|---|---|---|
| Zr69Ni1Cu24Al6 | ○ | Zr2Cu |
| Zr71Ni22Cu1Al6 | X | — |
| Zr71Ni20Cu3Al6 | ○ | I-phase |
| Zr71Ni16Cu7Al6 | ○ | I-phase |
| Zr71Ni12Cu11Al6 | ○ | I-phase |
| Zr71Ni8Cu15Al6 | ○ | I-phase |
| Zr71Ni4Cu19Al6 | ○ | I-phase |
| Zr73Ni20Cu1Al6 | X | — |
| Zr73Ni18Cu3Al6 | ○ | I-phase |
| Zr73Ni14Cu7Al6 | ○ | I-phase |
| Zr73Ni10Cu11Al6 | ○ | I-phase |
| Zr73Ni6Cu15Al6 | ○ | I-phase |
| Zr73Ni1Cu20Al6 | X | — |
| Zr75Ni18Cu1Al6 | X | — |
| Zr75Ni16Cu3Al6 | ○ | β-Zr |
| Zr75Ni14Cu5Al6 | ○ | β-Zr |
| Zr75Ni12Cu7Al6 | ○ | β-Zr |
| Zr75Ni10Cu9Al6 | ○ | β-Zr |
| Zr75Ni8Cu11Al6 | ○ | β-Zr |
| Zr75Ni6Cu13Al6 | ○ | β-Zr |
| Zr75Ni4Cu15Al6 | ○ | β-Zr |
| Zr75Ni1Cu17Al6 | X | — |
| Zr77Ni16Cu1Al6 | X | — |
| Zr77Ni14Cu3Al6 | X | — |
| Zr77Ni12Cu5Al6 | X | — |
| Zr77Ni10Cu7Al6 | X | — |
| Zr77Ni18Cu9Al6 | X | — |
| Zr77Ni6Cu11Al6 | X | — |
| Zr77Ni4Cu13Al6 | X | — |
| Zr77Ni1Cu16Al6 | X | — |
| Zr59Ni28Cu1Al12 | X | — |
| Zr59Ni26Cu3Al12 | ○ | Zr2Ni, ZrAl, Zr2Cu |
| Zr59Ni21Cu7Al12 | ○ | Zr2Ni, ZrAl, Zr2Cu |
| Zr59Ni18Cu11Al12 | ○ | Zr2Ni, ZrAl, Zr2Cu |
| Zr59Ni14Cu15Al12 | ○ | Zr2Ni, ZrAl, Zr2Cu |
| Zr59Ni10Cu19Al12 | ○ | Zr2Ni, ZrAl, Zr2Cu |
| Zr59Ni6Cu23Al12 | ○ | Zr2Ni, ZrAl, Zr2Cu |
| Zr59Ni1Cu28Al12 | ○ | Zr2Cu |
| Zr61Ni26Cu1Al12 | X | — |
| Zr61Ni24Cu3Al12 | ○ | Zr2Ni, ZrAl, Zr2Cu |
| Zr61Ni20Cu7Al12 | ○ | Zr2Ni, ZrAl, Zr2Cu |
| Zr61Ni16Cu11Al12 | ○ | Zr2Ni, ZrAl, Zr2Cu |
| Zr61Ni12Cu15Al12 | ○ | Zr2Ni, ZrAl, Zr2Cu |
| Zr61Ni8Cu19Al12 | ○ | Zr2Ni, ZrAl, Zr2Cu |
| Zr61Ni4Cu23Al12 | ○ | Zr2Ni, ZrAl, Zr2Cu |
| Zr63Ni24Cu1Al12 | X | — |
| Zr63Ni22Cu3Al12 | ○ | Zr2Ni, ZrAl, Zr2Cu |
| Zr63Ni18Cu7Al12 | ○ | Zr2Ni, ZrAl, Zr2Cu |
| Zr63Ni14Cu11Al12 | ○ | Zr2Ni, ZrAl, Zr2Cu |
| Zr63Ni10Cu15Al12 | ○ | Zr2Ni, ZrAl, Zr2Cu |
| Zr63Ni6Cu19Al12 | ○ | Zr2Ni, ZrAl, Zr2Cu |
| Zr63Ni1Cu24Al12 | ○ | Zr2Cu |
| Zr65Ni22Cu1Al12 | X | — |
| Zr65Ni20Cu3Al12 | ○ | Zr2Ni, ZrAl, Zr2Cu |
| Zr65Ni16Cu7Al12 | ○ | Zr2Ni, ZrAl, Zr2Cu |
| Zr65Ni12Cu11Al12 | ○ | Zr2Ni, ZrAl, Zr2Cu |
| Zr65Ni8Cu15Al12 | ○ | Zr2Ni, ZrAl, Zr2Cu |
| Zr65Ni4Cu19Al12 | ○ | Zr2Ni, ZrAl, Zr2Cu |
| Zr67Ni20Cu1Al12 | X | — |
| Zr67Ni18Cu3Al12 | ○ | Zr2Ni, ZrAl, Zr2Cu |
| Zr67Ni14Cu7Al12 | ○ | Zr2Ni, ZrAl, Zr2Cu |
| Zr67Ni10Cu11Al12 | ○ | Zr2Ni, ZrAl, Zr2Cu |
| Zr67Ni6Cu15Al12 | ○ | Zr2Ni, ZrAl, Zr2Cu |
| Zr67Ni1Cu20Al12 | ○ | Zr2Cu |
| Zr69Ni18Cu1Al12 | X | — |
| Zr69Ni16Cu3Al12 | ○ | I-phase |
| Zr69Ni14Cu5Al12 | ○ | I-phase |
| Zr69Ni12Cu7Al12 | ○ | I-phase |
| Zr69Ni10Cu9Al12 | ○ | I-phase |
| Zr69Ni8Cu11Al12 | ○ | I-phase |
| Zr69Ni6Cu13Al12 | ○ | I-phase |
| Zr69Ni4Cu15Al12 | ○ | I-phase |
| Zr69Ni1Cu17Al12 | ○ | Zr2Cu |
| Zr70Ni9Cu9Al12 | ○ | I-phase |
| Zr71Ni16Cu1Al12 | X | — |
| Zr71Ni14Cu3Al12 | ○ | I-phase |
| Zr71Ni12Cu5Al12 | ○ | I-phase |

TABLE 2-continued

| Composition | 10 μm ribbon amorphous formation | Primary phase |
|---|---|---|
| Zr71Ni10Cu7Al12 | ○ | I-phase |
| Zr71Ni18Cu9Al12 | ○ | I-phase |
| Zr71Ni6Cu11Al12 | ○ | I-phase |
| Zr71Ni4Cu13Al12 | ○ | I-phase |
| Zr71Ni1Cu16Al12 | ○ | Zr2Cu |
| Zr73Ni14Cu1Al12 | X | — |
| Zr73Ni12Cu3Al12 | ○ | I-phase |
| Zr73Ni10Cu5Al12 | ○ | I-phase |
| Zr73Ni18Cu7Al12 | ○ | I-phase |
| Zr73Ni6Cu9Al12 | ○ | I-phase |
| Zr73Ni4Cu11Al12 | ○ | I-phase |
| Zr73Ni1Cu14Al12 | X | — |
| Zr75Ni12Cu1Al12 | X | — |
| Zr75Ni10Cu3Al12 | ○ | β-Zr |
| Zr75Ni18Cu5Al12 | ○ | β-Zr |
| Zr75Ni6Cu7Al12 | ○ | β-Zr |
| Zr75Ni4Cu9Al12 | ○ | β-Zr |
| Zr75Ni2Cu11Al12 | X | — |
| Zr77Ni8Cu3Al12 | X | — |
| Zr77Ni6Cu5Al12 | X | — |
| Zr77Ni3Cu8Al12 | X | — |
| Zr65Ni8Cu15Al12 | ○ | Zr2Ni, ZrAl, Zr2Cu |
| Zr55Ni26Cu1Al18 | X | — |
| Zr55Ni24Cu3Al18 | ○ | Zr2Ni, ZrAl, Zr2Cu |
| Zr55Ni20Cu7Al18 | ○ | Zr2Ni, ZrAl, Zr2Cu |
| Zr55Ni16Cu11Al18 | ○ | Zr2Ni, ZrAl, Zr2Cu |
| Zr55Ni12Cu15Al18 | ○ | Zr2Ni, ZrAl, Zr2Cu |
| Zr5Ni8Cu19Al18 | ○ | Zr2Ni, ZrAl, Zr2Cu |
| Zr55Ni4Cu23Al18 | ○ | Zr2Ni, ZrAl, Zr2Cu |
| Zr57Ni24Cu1Al18 | X | — |
| Zr57Ni22Cu3Al18 | ○ | Zr2Ni, ZrAl, Zr2Cu |
| Zr57Ni18Cu7Al18 | ○ | Zr2Ni, ZrAl, Zr2Cu |
| Zr57Ni14Cu11Al18 | ○ | Zr2Ni, ZrAl, Zr2Cu |
| Zr57Ni10Cu15Al18 | ○ | Zr2Ni, ZrAl, Zr2Cu |
| Zr57Ni6Cu19Al18 | ○ | Zr2Ni, ZrAl, Zr2Cu |
| Zr57Ni1Cu24Al18 | ○ | Zr2Cu |
| Zr59Ni22Cu1Al18 | X | — |
| Zr59Ni20Cu3Al18 | ○ | Zr2Ni, ZrAl, Zr2Cu |
| Zr59Ni16Cu7Al18 | ○ | Zr2Ni, ZrAl, Zr2Cu |
| Zr59Ni12Cu11Al18 | ○ | Zr2Ni, ZrAl, Zr2Cu |
| Zr59Ni8Cu15Al18 | ○ | Zr2Ni, ZrAl, Zr2Cu |
| Zr59Ni4Cu19Al18 | ○ | Zr2Ni, ZrAl, Zr2Cu |
| Zr61Ni20Cu1Al18 | X | — |
| Zr61Ni18Cu3Al18 | ○ | Zr2Ni, ZrAl, Zr2Cu |
| Zr61Ni14Cu7Al18 | ○ | Zr2Ni, ZrAl, Zr2Cu |
| Zr61Ni10Cu11Al18 | ○ | Zr2Ni, ZrAl, Zr2Cu |
| Zr61Ni6Cu15Al18 | ○ | Zr2Ni, ZrAl, Zr2Cu |
| Zr61Ni1Cu20Al18 | ○ | Zr2Cu |
| Zr63Ni18Cu1Al18 | X | — |
| Zr63Ni16Cu3Al18 | ○ | Zr2Ni, ZrAl, Zr2Cu |
| Zr63Ni14Cu5Al18 | ○ | Zr2Ni, ZrAl, Zr2Cu |
| Zr63Ni12Cu7Al18 | ○ | Zr2Ni, ZrAl, Zr2Cu |
| Zr63Ni10Cu9Al18 | ○ | Zr2Ni, ZrAl, Zr2Cu |
| Zr63Ni8Cu11Al18 | ○ | Zr2Ni, ZrAl, Zr2Cu |
| Zr63Ni6Cu13Al18 | ○ | Zr2Ni, ZrAl, Zr2Cu |
| Zr63Ni4Cu15Al18 | ○ | Zr2Ni, ZrAl, Zr2Cu |
| Zr63Ni1Cu17Al18 | ○ | Zr2Cu |
| Zr65Ni16Cu1Al18 | X | — |
| Zr65Ni14Cu3Al18 | ○ | Zr2Ni, ZrAl, Zr2Cu |
| Zr65Ni12Cu5Al18 | ○ | Zr2Ni, ZrAl, Zr2Cu |
| Zr65Ni10Cu7Al18 | ○ | Zr2Ni, ZrAl, Zr2Cu |
| Zr65Ni18Cu9Al18 | ○ | Zr2Ni, ZrAl, Zr2Cu |
| Zr65Ni6Cu11Al18 | ○ | Zr2Ni, ZrAl, Zr2Cu |
| Zr65Ni4Cu13Al18 | ○ | Zr2Ni, ZrAl, Zr2Cu |
| Zr65Ni1Cu16Al18 | ○ | Zr2Ni, ZrAl, Zr2Cu |
| Zr67Ni14Cu1Al18 | X | — |
| Zr67Ni12Cu3Al18 | ○ | Zr2Ni, ZrAl, Zr2Cu |
| Zr67Ni10Cu5Al18 | ○ | Zr2Ni, ZrAl, Zr2Cu |
| Zr67Ni18Cu7Al18 | ○ | Zr2Ni, ZrAl, Zr2Cu |
| Zr67Ni6Cu9Al18 | ○ | Zr2Ni, ZrAl, Zr2Cu |
| Zr67Ni4Cu11Al18 | ○ | Zr2Ni, ZrAl, Zr2Cu |
| Zr67Ni1Cu14Al18 | X | — |
| Zr69Ni12Cu1Al18 | X | — |
| Zr69Ni10Cu3Al18 | ○ | Zr2Ni, ZrAl, Zr2Cu |
| Zr69Ni18Cu5Al18 | ○ | Zr2Ni, ZrAl, Zr2Cu |
| Zr69Ni6Cu7Al18 | ○ | Zr2Ni, ZrAl, Zr2Cu |
| Zr69Ni4Cu9Al18 | ○ | Zr2Ni, ZrAl, Zr2Cu |

TABLE 2-continued

| Composition | 10 μm ribbon amorphous formation | Primary phase |
|---|---|---|
| Zr69Ni2Cu11Al18 | X | — |
| Zr71Ni8Cu3Al18 | ○ | I-phase |
| Zr71Ni6Cu5Al18 | ○ | I-phase |
| Zr71Ni3Cu8Al18 | ○ | I-phase |
| Zr73Ni8Cu1Al18 | X | |
| Zr73Ni6Cu3Al18 | ○ | I-phase |
| Zr73Ni4Cu5Al18 | ○ | I-phase |
| Zr73Ni2Cu7Al18 | X | |
| Zr75Ni6Cu1Al18 | X | — |
| Zr75Ni4Cu3Al18 | ○ | β-Zr |
| Zr75Ni2Cu5Al18 | ○ | β-Zr |
| Zr75Ni1Cu6Al18 | X | — |
| Zr77Ni4Cu1Al18 | X | — |
| Zr77Ni2Cu3Al18 | X | — |
| Zr77Ni1Cu4Al18 | X | — |
| Zr65Ni12Cu19Al4 | X | — |
| Zr65Ni11Cu18Al6 | ○ | Zr2Ni, ZrAl, Zr2Cu |
| Zr65Ni10Cu17Al8 | ○ | Zr2Ni, ZrAl, Zr2Cu |
| Zr65Ni9Cu16Al10 | ○ | Zr2Ni, ZrAl, Zr2Cu |
| Zr65Ni7Cu14Al14 | ○ | Zr2Ni, ZrAl, Zr2Cu |
| Zr65Ni6Cu13Al16 | ○ | Zr2Ni, ZrAl, Zr2Cu |
| Zr65Ni5Cu12Al18 | ○ | Zr2Ni, ZrAl, Zr2Cu |
| Zr65Ni4Cu11Al20 | X | — |

Referring to FIG. 6 and Table 2, when a quaternary amorphous alloy specimen itself included an Al content of 12 atomic % and each Ni and Cu content of about 29 atomic % or less, a 10 μm ribbon-based amorphous phase was well formed, and through the precipitation of the $Zr_2Ni$ and/or I-phases as primary phases confirmed that principal clusters or quenched-in icosahedral nuclei with a $Zr_2Ni$ composition were dispersed inside the quaternary amorphous alloy matrix.

However, when the quaternary amorphous alloy specimen itself had a Ni and Cu content sum of less than about 15 atomic %, while the Al content was fixed into 12 atomic %, the 10 μm ribbon-based amorphous phase and the crystalline phase were formed together, but a complete amorphous alloy, which exhibits a halo peak alone in the X-ray diffraction analysis, was not formed.

On the other hand, referring to Table 2, when the quaternary amorphous alloy specimen itself had a $Zr_{75}Ni_{18}Cu_5Al_{12}$ composition with a larger Zr content, β-Zr was precipitated as primary phases in the quaternary amorphous alloy matrix to form β-Zr clusters, but the principal clusters or quenched-in icosahedral nuclei with the $Zr_2Ni$ composition were not formed.

In addition, when the quaternary amorphous alloy specimen itself had a $Zr_{71}Ni_1Cu_{16}Al_{12}$ composition with an extremely large Cu content, as $Zr_2Cu$ was precipitated as primary phases, $Zr_2Cu$ clusters were formed in the quaternary amorphous alloy matrix, but the principal clusters or quenched-in icosahedral nuclei with a $Zr_2Ni$ composition were not formed.

On the other hand, when the quaternary amorphous alloy specimen itself had $Zr_{65}Cu_{15}Ni_8Al_{12}$, $Zr_{63}Cu_7Ni_{18}Al_{12}$, and the like within a composition range of the novel amorphous alloy of an embodiment, the principal cluster or quenched-in icosahedral nuclei with a $Zr_2Ni$ composition, or both of them were formed inside the quaternary amorphous alloy matrix.

Experimental Example 2: XRD after Casting a Quaternary Bulk Amorphous Alloy and after First Crystallization After fixing the Al content into 12 atomic %, each Ni and Cu content was changed as shown in Table 3, and Zr was added thereto as a balance, preparing a quaternary amorphous alloy raw material mixture.

The quaternary amorphous alloy raw material mixture was melted at 2000° C. for 10 minutes, preparing a molten metal. The molten metal was cooled to 1000° C./s for 3 seconds or less and then, formed into a bar shape with a size of 1 mm, obtaining a quaternary amorphous alloy specimen.

An X-ray diffraction analyzer (New D8 Advance, Bruker Corporation) was used to analyze a structure of the obtained specimen and thus determine whether or not crystalline phases were precipitated inside the quaternary amorphous alloy specimen and particularly, analyze the primary phases and thus determine whether or not $Zr_2Ni$ phases or Icosahedral phases (I-phases) were formed, and the results are shown in Table 3.

TABLE 3

| Composition | 1 mm rod-shaped amorphous formation | Primary phase |
|---|---|---|
| Zr59Cu1Ni28Al12 | X | — |
| Zr59Cu3Ni26Al12 | X | NiZr2, AlZr, CuZr2 |
| Zr59Cu7Ni21Al12 | ○ | NiZr2, AlZr, CuZr2 |
| Zr59Cu11Ni18Al12 | ○ | NiZr2, AlZr, CuZr2 |
| Zr59Cu15Ni14Al12 | ○ | NiZr2, AlZr, CuZr2 |
| Zr59Cu19Ni10Al12 | ○ | NiZr2, AlZr, CuZr2 |
| Zr59Cu23Ni6Al12 | ○ | NiZr2, AlZr, CuZr2 |
| Zr59Cu28Ni1Al12 | X | CuZr2 |
| Zr61Cu1Ni26Al12 | X | — |
| Zr61Cu3Ni24Al12 | X | NiZr2, AlZr, CuZr2 |
| Zr61Cu7Ni20Al12 | ○ | NiZr2, AlZr, CuZr2 |
| Zr61Cu11Ni16Al12 | ○ | NiZr2, AlZr, CuZr2 |
| Zr61Cu15Ni12Al12 | ○ | NiZr2, AlZr, CuZr2 |
| Zr61Cu19Ni8Al12 | ○ | NiZr2, AlZr, CuZr2 |
| Zr61Cu23Ni4Al12 | X | NiZr2, AlZr, CuZr2 |
| Zr63Cu1Ni24Al12 | X | — |
| Zr63Cu3Ni22Al12 | X | NiZr2, AlZr, CuZr2 |
| Zr63Cu7Ni18Al12 | ○ | NiZr2, AlZr, CuZr2 |
| Zr63Cu11Ni14Al12 | ○ | NiZr2, AlZr, CuZr2 |
| Zr63Cu15Ni10Al12 | ○ | NiZr2, AlZr, CuZr2 |
| Zr63Cu19Ni6Al12 | ○ | NiZr2, AlZr, CuZr2 |
| Zr63Cu24Ni1Al12 | X | CuZr2 |
| Zr65Cu1Ni22Al12 | X | — |
| Zr65Cu3Ni20Al12 | X | NiZr2, AlZr, CuZr2 |
| Zr65Cu7Ni16Al12 | ○ | NiZr2, AlZr, CuZr2 |
| Zr65Cu11Ni12Al12 | ○ | NiZr2, AlZr, CuZr2 |
| Zr65Cu15Ni8Al12 | ○ | NiZr2, AlZr, CuZr2 |
| Zr65Cu19Ni4Al12 | X | NiZr2, AlZr, CuZr2 |
| Zr67Cu1Ni20Al12 | X | — |
| Zr67Cu3Ni18Al12 | X | NiZr2, AlZr, CuZr2 |
| Zr67Cu7Ni14Al12 | ○ | NiZr2, AlZr, CuZr2 |
| Zr67Cu11Ni10Al12 | ○ | NiZr2, AlZr, CuZr2 |
| Zr67Cu15Ni6Al12 | ○ | NiZr2, AlZr, CuZr2 |
| Zr67Cu20Ni1Al12 | X | CuZr2 |
| Zr69Cu1Ni18Al12 | X | — |
| Zr69Cu3Ni16Al12 | X | I-phase |
| Zr69Cu5Ni14Al12 | ○ | I-phase |
| Zr69Cu7Ni12Al12 | ○ | I-phase |
| Zr69Cu9Ni10Al12 | ○ | I-phase |
| Zr69Cu11Ni8Al12 | ○ | I-phase |
| Zr69Cu13Ni6Al12 | ○ | I-phase |
| Zr69Cu15Ni4Al12 | X | I-phase |
| Zr69Cu17Ni1Al12 | X | CuZr2 |
| Zr70Cu9Ni9Al12 | ○ | I-phase |
| Zr71Cu1Ni16Al12 | X | — |
| Zr71Cu3Ni14Al12 | X | I-phase |
| Zr71Cu5Ni12Al12 | X | I-phase |
| Zr71Cu7Ni10Al12 | X | I-phase |
| Zr71Cu9Ni18Al12 | X | I-phase |
| Zr71Cu11Ni6Al12 | X | I-phase |
| Zr71Cu13Ni4Al12 | X | I-phase |
| Zr71Cu16Ni1Al12 | X | CuZr2 |
| Zr73Cu1Ni14Al12 | X | — |
| Zr73Cu3Ni12Al12 | X | I-phase |
| Zr73Cu5Ni10Al12 | X | I-phase |
| Zr73Cu7Ni18Al12 | X | I-phase |
| Zr73Cu9Ni6Al12 | X | I-phase |

TABLE 3-continued

| Composition | 1 mm rod-shaped amorphous formation | Primary phase |
|---|---|---|
| Zr73Cu11Ni4Al12 | X | I-phase |
| Zr73Cu14Ni1Al12 | X | — |
| Zr75Cu1Ni12Al12 | X | — |
| Zr75Cu3Ni10Al12 | X | β-Zr |
| Zr75Cu5Ni18Al12 | X | β-Zr |
| Zr75Cu7Ni6Al12 | X | β-Zr |
| Zr75Cu9Ni4Al12 | X | β-Zr |
| Zr75Cu11Ni2Al12 | X | — |
| Zr77Cu3Ni8Al12 | X | — |
| Zr77Cu5Ni6Al12 | X | — |
| Zr77Cu8Ni3Al12 | X | — |
| Zr70Cu9Ni9Al12 | ○ | I-phase |
| Zr70Cu13Ni13Al4 | X | — |
| Zr70Cu12Ni12Al6 | ○ | I-phase |
| Zr70Cu11Ni11Al8 | ○ | I-phase |
| Zr70Cu10Ni10Al10 | ○ | I-phase |
| Zr70Cu8Ni8Al14 | ○ | I-phase |
| Zr70Cu7Ni7Al16 | ○ | I-phase |
| Zr70Cu6Ni6Al18 | ○ | I-phase |
| Zr70Cu5Ni5Al20 | X | — |

Referring to Table 3, when the quaternary amorphous alloy specimen itself was prepared, the Zr content of 60 to 70 atomic %, the Ni content of 5 to 21 atomic %, the Cu content of 5 to 21 atomic %, and the Al content of 6 to 18 atomic % were prepared into a bulk amorphous alloy with a thickness of 1 mm or more, and $Zr_2Ni$ and/or I phases were precipitated as primary phases, so that principal clusters or quenched-in icosahedral nuclei with a $Zr_2Ni$ composition were dispersed inside the bulk amorphous alloy matrix.

Experimental Example 3: XRD of Complex Concentrated Alloy (CCA)

A raw material mixture was prepared by selecting two or more elements from a group consisting of Ti, Zr, Hf, V, Nb, Ta, and Mo according to a composition shown in Table 4.

The raw material mixture was melted at 3500° C. for 10 minutes, preparing a molten metal. The molten metal was cooled at 250° C./s for 10 seconds or less and formed into a bar shape with a size of 2 mm or less, obtaining a OCA specimen according to Experimental Example 3.

An X-ray diffraction analyzer (New D8 Advance, Bruker Corporation) was used to analyze a crystalline structure precipitated inside the OCA specimen.

TABLE 4

| Alloy composition | Phase |
|---|---|
| $Ti_{95}Nb_5$ | BCC |
| $Nb_{95}Ta_5$ | BCC |
| $Zr_5Hf_{95}$ | BCC |
| $Zr_{95}Hf_5$ | BCC |
| $Mo_5Ta_{95}$ | BCC |
| $Mo_{95}Ta_5$ | BCC |
| $Ti_5Hf_5Zr_{90}$ | BCC |
| $Nb_5Ta_5Zr_{90}$ | BCC |
| $Ti_5Nb_5Ta_5Zr_{85}$ | BCC |
| $Nb_5Ta_5Mo_{90}$ | BCC |
| $Ti_{33.3}Zr_{33.3}Hf_{33.3}$ | BCC |
| $Ti_{33.3}Zr_{33.3}V_{33.3}$ | BCC |
| $Ti_{33.3}Zr_{33.3}Nb_{33.3}$ | BCC |
| $Ti_{10}Zr_{30}Nb_{60}$ | BCC |
| $Ti_{10}Zr_{70}Nb_{20}$ | BCC |
| $Ti_{33.3}Zr_{33.3}Ta_{33.3}$ | BCC |
| $Ti_{20}Zr_{20}Ta_{60}$ | BCC |
| $Ti_{25}Zr_{25}Nb_{25}Ta_{25}$ | BCC |
| $Ti_{15}Zr_{15}Nb_{35}Ta_{35}$ | BCC |
| $Ti_{33.3}Hf_{33.3}Nb_{33.3}$ | BCC |

TABLE 4-continued

| Alloy composition | Phase |
|---|---|
| $Ti_{33.3}Hf_{33.3}Ta_{33.3}$ | BCC |
| $Ti_{25}Hf_{25}Nb_{25}Ta_{25}$ | BCC |
| $V_{33.3}Nb_{33.3}Ta_{33.3}$ | BCC |
| $V_{25}Nb_{25}Ta_{25}Mo_{25}$ | BCC |
| $V_{33.3}Nb_{33.3}Mo_{33.3}$ | BCC |
| $V_{33.3}Ta_{33.3}Mo_{33.3}$ | BCC |
| $Ti_{20}Zr_{20}Hf_{20}Nb_{20}Ta_{20}$ | BCC |
| $V_{25}Nb_{25}Ta_{25}Mo_{25}$ | BCC |
| $Ti_{25}Nb_{25}Ta_{25}Mo_{25}$ | BCC |
| $Ti_{16.7}Zr_{16.7}Hf_{16.7}V_{16.7}Nb_{16.7}Ta_{6.7}$ | BCC |
| $Ti_5Zr_5Hf_5V_{28.3}Nb_{28.3}Ta_{28.3}$ | BCC |
| $Ti_{2.86}Zr_{2.86}Hf_{2.86}V_{20}Nb_{20}Ta_{20}Mo_{20}$ | BCC |
| $Ti_{14.3}Zr_{14.3}Hf_{14.3}V_{14.3}Nb_{14.3}Ta_{14.3}Mo_{14.3}$ | BCC |
| $Ti_{32.5}V_{15.4}Nb_{22.6}Hf_{24.1}$ | BCC |
| $Ti_{15}V_{38}Nb_{23}Hf_{24}$ | BCC |
| $Ti_{26.5}V_{26.5}Nb_{23}Hf_{24}$ | BCC |
| $Ti_{38}V_{15}Nb_{23}Hf_{24}$ | BCC |
| $(Nb_{50}Ta_{50})_{0.2}(Mo_{50}V_{50})_{0.8}$ | BCC |
| $(Nb_{50}Ta_{50})_{0.4}(Mo_{50}V_{50})_{0.6}$ | BCC |
| $(Nb_{50}Ta_{50})_{0.6}(Mo_{50}V_{50})_{0.4}$ | BCC |
| $(Nb_{50}Ta_{50})_{0.8}(Mo_{50}V_{50})_{0.2}$ | BCC |
| $Ti_{10}Nb_9Ta_9Mo_{36}V_{36}$ | BCC |
| $Ti_{20}Nb_8Ta_8M_{032}V_{32}$ | BCC |
| $Ti_{30}Nb_7Ta_7Mo_{28}V_{28}$ | BCC |

Figure 7:
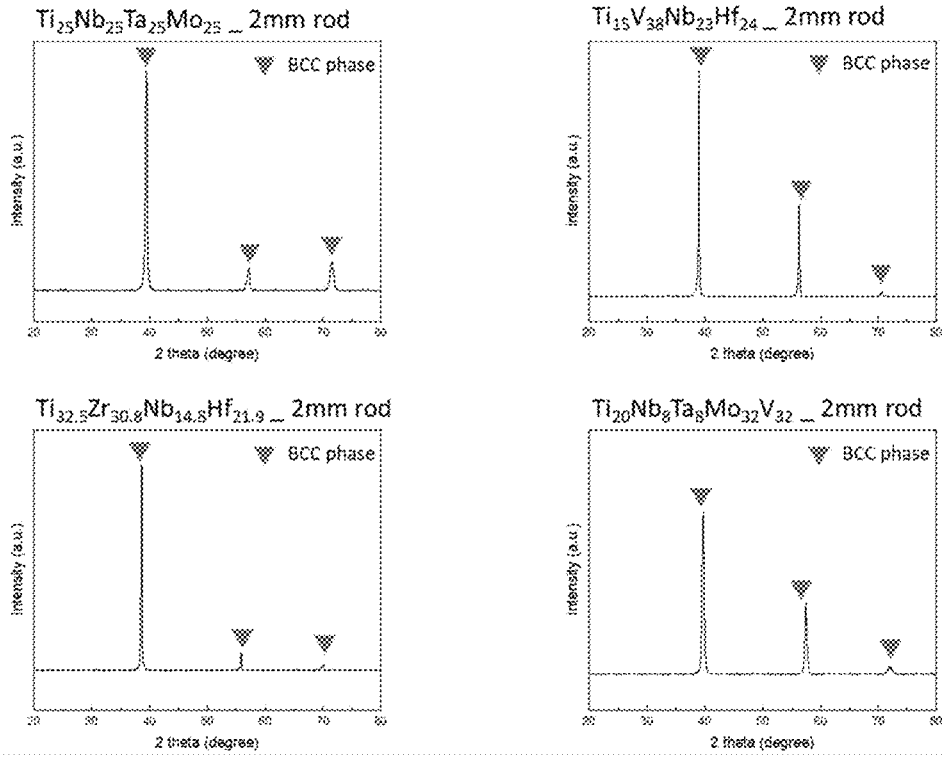
FIG. 7 is a graph showing an X-ray diffraction analysis of 2 mm rod-shaped CCA specimens of each composition of $Ti_{25}Nb_{25}Ta_{25}Mo_{25}$, $Ti_{15}V_{38}Nb_{23}Hf_{24}$, $Ti_{32.5}Zr_{30.8}Nb_{14.8}Hf_{21.9}$, and $Ti_{20}Nb_8Ta_8Mo_{32}V_{32}$.

FIG. 7 is a graph showing an X-ray diffraction analysis of the 2 mm rod-shaped CCA specimens having each composition of $Ti_{25}Nb_{25}Ta_{25}Mo_{25}$, $Ti_{15}V_{38}Nb_{23}Hf_{24}$, $Ti_{32.5}Zr_{30.8}Nb_{14.8}Hf_{21.9}$, and $Ti_{20}Nb_8Ta_8Mo_{32}V_{32}$.

Referring to FIG. 7 and Table 4, CCA including two or more elements selected from the group consisting of Ti, Zr, Hf, V, Nb, Ta, and Mo formed a single-phase BCC structure. Herein, each content of the elements constituting CCA may be selected within a wide range of 5 to 95 atomic % in which interactions between solute elements are activated.

Experimental Example 4: XRD of an Amorphous Alloy Including CCA Using a Quaternary Amorphous Alloy as a Matrix, Differential Scanning Calorimetry, Etc An amorphous alloy with a composition of $Zr_{65}Ni_{12}Cu_{15-d}Al_8(CCA)_d$ was prepared by setting the quaternary amorphous alloy matrix to a composition of $Zr_{65}Ni_{12}Cu_{15-d}Al_8$ and changing the composition and the content of CCA as shown in Table 5.

Specifically, a CCA raw material mixture was prepared according to a composition of Table 5 and then, melted at 3500° C. for 10 minutes, preparing a CCA molten metal. The CCA molten metal was cooled at 10° C./s for 10 minutes or less, obtaining a CCA specimen. Herein, the composition of CCA was used to calculate Equation 1, and the results are shown in Table 5.

$$10.0 \leq \{(1/3)*(x+n+o+p)+(1/6.9)*y+(1/7)*(z+m)\} \quad \text{[Equation 1]}$$

In Equation 1, x is an atomic fraction of Ti in Chemical Formula 1; y is an atomic fraction of Zr in Chemical Formula 1; z is an atomic fraction of Hf in Chemical Formula 1; m is an atomic fraction of V in Chemical Formula 1; n is an atomic fraction of Nb in Chemical Formula 1; o is an atomic fraction of Ta in Chemical Formula 1; and p is an atomic fraction of Mo in Chemical Formula 1.

Subsequently, after adding Zr, Ni, Cu, and Al according to a stoichiometric atomic ratio of $Zr_{65}Ni_{12}Cu_{15-d}Al_8$ to the CCA specimen, the raw material mixture of the $Zr_{65}Ni_{12}Cu_{15-d}Al_8$ and CCA was melted at 3000° C. for 10 minutes, preparing the molten metal of $Zr_{65}Ni_{12}Cu_{15-d}Al_8(CCA)_d$.

Then, the molten metal was cooled to 250° C./s for 10 seconds or less and then, formed into a bar shape with a size of 2 mm, obtaining an amorphous alloy specimen of Experimental Example 4.

An X-ray diffraction analyzer (New D8 Advance, Bruker Corporation) was used to analyze a structure of the amorphous alloy specimen and thus determine whether or not crystalline phases were precipitated in the amorphous alloy specimen and particularly, whether or not $Zr_2Ni$ phases or Icosahedral phases (1-phase) were formed as primary phases, and the results are shown in Table 5.

In addition, a differential scanning calorimeter (DSC, DSC 8500, Perkin Elmer) was used to analyze crystallization behaviors of the amorphous alloys and also, precipitated phases after a heat treatment to an apex of first crystallization behaviors, and the results were used to determine whether or not complex quasicrystal clusters were formed.

TABLE 5

| Addition alloy | Content (at. %) | 'Equation 1' calculation value | 10 μm ribbon amorphous formation | Primary phase |
|---|---|---|---|---|
| $Nb_{95}Ta_5$ | 0.5 | 9.58 | ○ | $Zr_2Ni$ |
| | 6 | 11.4 | ○ | I-phase |
| | 9 | 12.4 | ○ | I-phase |
| $Ti_{33.3}Zr_{33.3}Hf_{33.3}$ | 0.5 | 9.5 | ○ | $Zr_2Ni$ |
| | 6 | 10.6 | ○ | I-phase |
| | 9 | 11.2 | ○ | I-phase |
| $Ti_{33.3}Zr_{33.3}V_{33.3}$ | 0.5 | 9.5 | ○ | $Zr_2Ni$ |
| | 6 | 10.6 | ○ | I-phase |
| | 9 | 11.2 | ○ | I-phase |
| $Ti_{33.3}Zr_{33.3}Nb_{33.3}$ | 3 | 10.2 | ○ | I-phase |
| | 6 | 11.0 | ○ | I-phase |
| | 9 | 11.9 | ○ | I-phase |
| $Ti_{33.3}Zr_{33.3}Ta_{33.3}$ | 3 | 10.2 | ○ | I-phase |
| | 6 | 11.0 | ○ | I-phase |
| $Ti_{25}Zr_{25}Nb_{25}Ta_{25}$ | 2 | 10.0 | ○ | I-phase |
| | 8 | 11.7 | ○ | I-phase |
| $Ti_{33.3}Hf_{33.3}Nb_{33.3}$ | 0.5 | 9.5 | ○ | $Zr_2Ni$ |
| | 3 | 10.2 | ○ | I-phase |
| | 6 | 11.0 | ○ | I-phase |
| $Ti_{33.3}Hf_{33.3}Ta_{33.3}$ | 0.5 | 9.5 | ○ | $Zr_2Ni$ |
| | 3 | 10.2 | ○ | I-phase |
| | 6 | 11.0 | ○ | I-phase |
| $Ti_{25}Hf_{25}Nb_{25}Ta_{25}$ | 4 | 10.5 | ○ | I-phase |
| | 8 | 11.7 | ○ | I-phase |
| $V_{33.3}Nb_{33.3}Ta_{33.3}$ | 3 | 10.2 | ○ | I-phase |
| | 6 | 11.0 | ○ | I-phase |
| $V_{25}Nb_{25}Ta_{25}Mo_{25}$ | 4 | 10.5 | ○ | I-phase |
| | 8 | 11.7 | ○ | I-phase |
| $V_{33.3}Nb_{33.3}Mo_{33.3}$ | 3 | 10.2 | ○ | I-phase |
| | 6 | 11.0 | ○ | I-phase |
| $V_{33.3}Ta_{33.3}Mo_{33.3}$ | 3 | 10.2 | ○ | I-phase |
| | 6 | 11.0 | ○ | I-phase |
| $Ti_{20}Zr_{20}Hf_{20}Nb_{20}Ta_{20}$ | 4 | 10.4 | ○ | I-phase |
| | 8 | 11.5 | ○ | I-phase |
| $V_{25}Nb_{25}Ta_{25}Mo_{25}$ | 4 | 10.5 | ○ | I-phase |
| | 10 | 11.4 | ○ | I-phase |
| $Ti_{25}Nb_{25}Ta_{25}M_{025}$ | 2 | 10.0 | ○ | I-phase |
| | 4 | 10.7 | ○ | I-phase |
| $Ti_{14.3}Zr_{14.3}Hf_{14.3}V_{14.3}Nb_{14.3}$ | 4 | 10.4 | ○ | I-phase |
| $Ta_{14.3}Mo_{14.3}$ | 8 | 11.4 | ○ | I-phase |
| $Ti_{32.5}V_{15.4}Nb_{22.6}Hf_{24.1}$ | 3 | 10.1 | ○ | I-phase |
| | 6 | 10.8 | ○ | I-phase |
| $Ti_{15}V_{38}Nb_{23}Hf_{24}$ | 4 | 10.3 | ○ | I-phase |
| | 8 | 11.1 | ○ | I-phase |
| $Ti_{26.5}V_{26.5}Nb_{23}Hf_{24}$ | 4 | 10.4 | ○ | I-phase |
| | 8 | 11.3 | ○ | I-phase |
| $Ti_{38}V_{15}Nb_{23}Hf_{24}$ | 4 | 10.5 | ○ | I-phase |
| | 8 | 11.5 | ○ | I-phase |
| $Ti_{20}Nb_8Ta_8Mo_{32}V_{32}$ | 0.5 | 9.5 | ○ | $Zr_2Ni$ |
| | 4 | 10.5 | ○ | I-phase |
| | 10 | 12.1 | ○ | I-phase |

Referring to Table 5, when CCA with a single-phase BOO structure was added in a composition of Equation 1, the CCA was dispersed in the quaternary amorphous alloy matrix, forming the complex quasicrystal clusters and thus maximizing a total distribution of level pressures between the complex quasicrystal clusters. Accordingly, thermal stability and mechanical stability of the novel amorphous alloy of an embodiment were significantly improved.

Experimental Example 5: XRD of an Amorphous Alloy Including CCA Using a Quaternary Amorphous Alloy as a Matrix, Differential Scanning Calorimetry, Etc The composition of the quaternary amorphous alloy matrix was $Zr_{65}Ni_{12}Cu_{15-d}Al_8$, and the composition of CCA was $Ti_{25}Nb_{25}Ta_{25}Mo_{25}$, but the content was changed according to the following to manufacture rod-shaped amorphous alloy specimens having a composition of $Zr_{65}Ni_{12}Cu_{15-d}Al_8(CCA)_d$ and a size of 2 mm.

Specifically, a CCA raw material mixture with a composition of $Ti_{25}Nb_{25}Ta_{25}Mo_{25}$ was prepared and then, melted at 3500° C. for 10 minutes, preparing a CCA molten metal. The CCA molten metal was cooled at 10° C./s for 10 minutes or less, obtaining a CCA specimen.

Subsequently, after adding Zr, Ni, Cu, and Al to the CCA specimen in consideration of a stoichiometric atomic ratio of $Zr_{65}Ni_{12}Cu_{15-d}Al_8$, the $Zr_{65}Ni_{12}Cu_{15-d}Al_8$ and CCA raw material mixture was melted at 3000° C. for 10 minutes, preparing the $Zr_{65}Ni_{12}Cu_{15-d}Al_8(CCA)_d$ molten metal.

Then, the molten metal was cooled at 250° C./s for 10 seconds or less and then molded into a bar shape with a size of 2 mm, obtaining an amorphous alloy specimen of Experimental Example 5.

Figure 8:
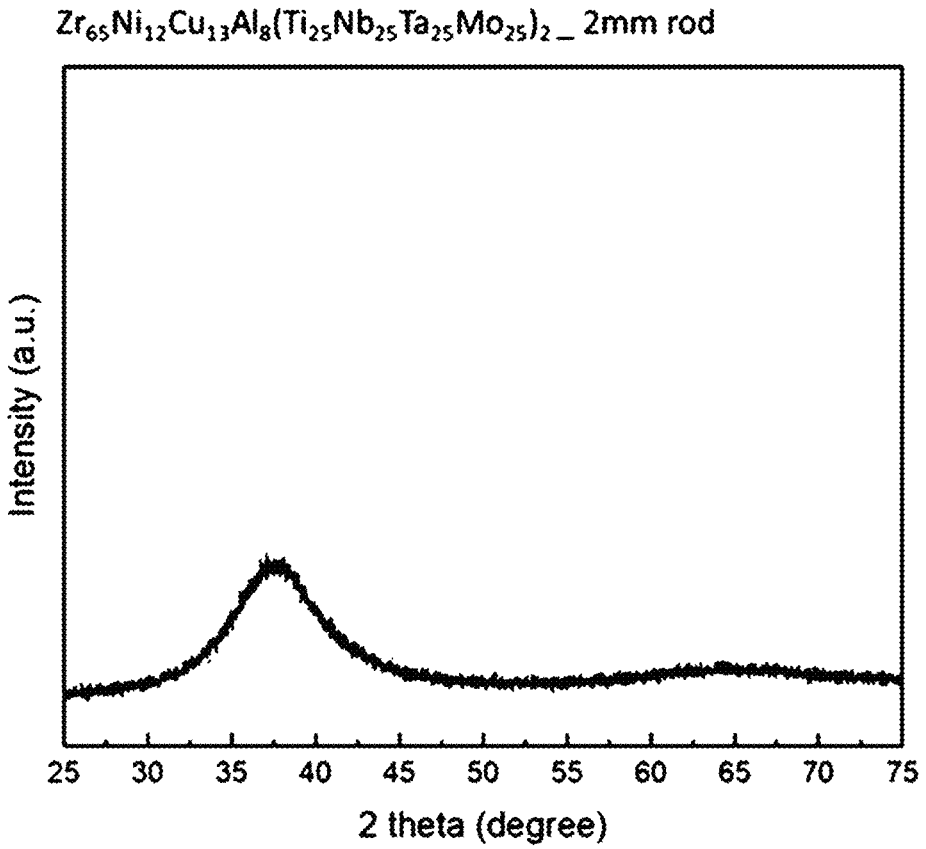
FIG. 8 is a graph showing an X-ray diffraction analysis of a 2 mm rod-shaped amorphous alloy specimen having a composition of $Zr_{65}Ni_{12}Cu_{13}Al_8(Ti_{25}Nb_{25}Ta_{25}Mo_{25})_2$.

An X-ray diffraction analyzer (New D8 Advance, Bruker Corporation) was used to analyze a structure of the alloy specimen, and the results are shown in FIG. 8.

Referring to FIG. 8, the 2 mm rod-shaped amorphous alloy specimen with the $Zr_{65}Ni_{12}Cu_{13}Al_8(Ti_{25}Nb_{25}Ta_{25}Mo_2)_2$ composition exhibited a halo pattern with a typical amorphous structure.

Figure 9:
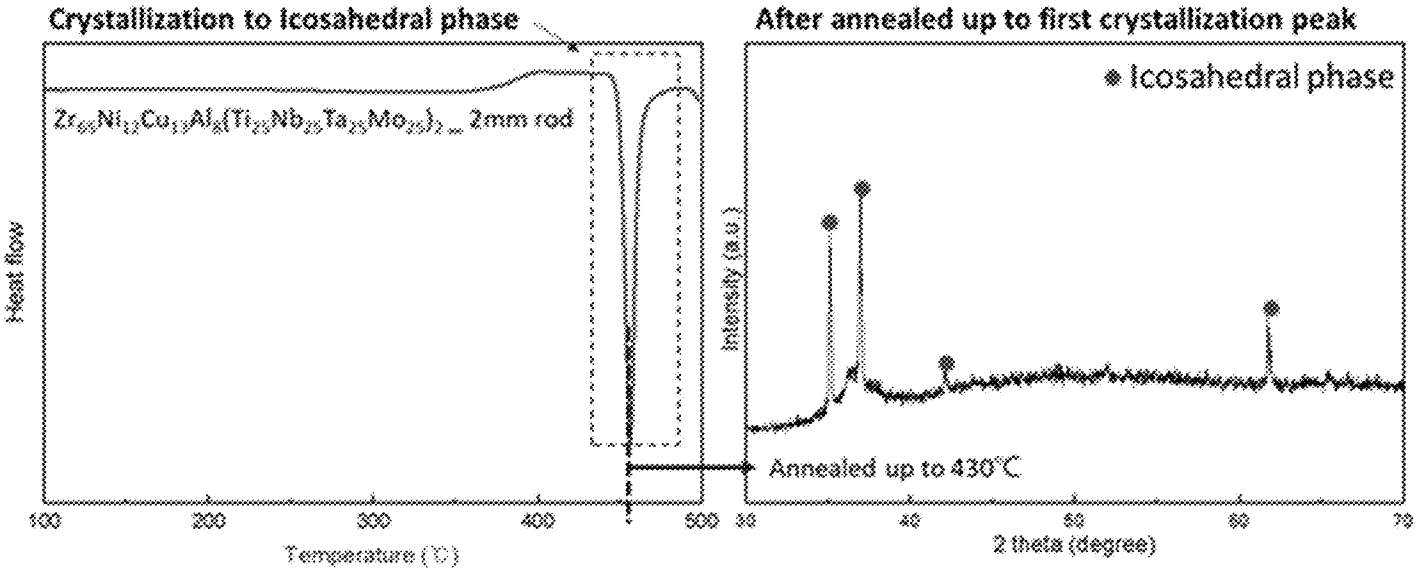
FIG. 9 is a graph (left) showing a differential scanning calorimetry analysis and a graph (right) showing an X-ray diffraction analysis of a 2 mm rod-shaped amorphous alloy specimen having a composition of $Zr_{65}Ni_{12}Cu_{13}Al_8(Ti_{25}Nb_{25}Ta_{25}Mo_{25})_2$.

On the other hand, a differential scanning calorimeter (DSC, DSC 8500, Perkin Elmer) was used to analyze the amorphous alloy specimen, and the results are shown in FIG. 9.

Referring to the left drawing of FIG. 9, the 2 mm rod-shaped amorphous alloy specimen with the $Zr_{65}Ni_{12}Cu_{13}Al_8(Ti_{25}Nb_{25}Ta_{25}Mo_{25})_2$ composition had a wide supercooled liquid region of about 50 K or more. Stability of this supercooling liquid is a factor directly related to excellent thermoplastic formability.

In addition, when the 2 mm rod-shaped amorphous alloy specimen with the $Zr_{65}Ni_{12}Cu_{13}Al_8(Ti_{25}Nb_{25}Ta_{25}Mo_{25})_2$ composition was heat-treated to 430° C. of an apex of first crystallization behaviors, I-phases were precipitated as primary phases (the right drawing of FIG. 9).

In general, when the primary phases are quasicrystal phases, since nuclei is easily produced due to characteristics of the quasicrystal phases during the cooling process, inevitably forming clusters. In this regard, since clear glass transitional behaviors were not confirmed before crystallization, complex quasicrystal clusters were inferred to be formed inside an amorphous matrix during the manufacturing process (particularly, cooling process) of the 2 mm rod-shaped amorphous alloy specimen with the $Zr_{65}Ni_{12}Cu_{13}Al_8(Ti_{25}Nb_{25}Ta_{25}Mo_{25})_2$ composition. In addition, during the heat treatment of the 2 mm rod-shaped amorphous alloy specimen with the $Zr_{65}Ni_{12}Cu_{13}Al_8(Ti_{25}Nb_{25}Ta_{25}Mo_{25})_2$ composition, complex quasicrystal clusters were inferred to grow inside the amorphous matrix, from which primary phases were precipitated. This behavior was confirmed by a fact that a peak related to crystalline growth during the isothermal heat treatment was observed from 80% or higher of a glass transition temperature before a crystallization onset temperature.

Furthermore, comprehensively considering FIGS. 6 and 9, when the original quaternary amorphous alloy system with the original $Zr_{55}Ni_{12}Cu_{15}Al_8$ composition, which formed primary phases of composite phases (ZrAl, $Zr_2Cu$, etc.) including $Zr_2Ni$ during the heat treatment, was prepared into the novel amorphous alloy by adding $Ti_{25}Nb_{25}Ta_{25}Mo_{25}$, a type of CCA, primary phases of quasicrystal (1-phase) alone were precipitated.

Accordingly, when the quaternary amorphous alloy system with the $Zr_{65}Ni_{12}Cu_{15}Al_8$ composition was prepared into the novel amorphous alloy by adding $Ti_{25}Nb_{25}Ta_{25}Mo_{25}$ thereto, the complex quasicrystal clusters including a plurality of quasicrystal nuclei and a free volume region where the quasicrystal nuclei do not exist were formed.

Experimental Example 6: Compression Test of an Amorphous Alloy Including CCA Using a Quaternary Amorphous Alloy as a Matrix The composition of the quaternary amorphous alloy matrix was $Zr_{65}Ni_{12}Cu_{15-d}Al_8$, and the composition of CCA was $Ti_{25}Nb_{25}Ta_{25}Mo_{25}$, but the content was changed as follows to manufacture a rod-shaped amorphous alloy specimen having a composition of $Zr_{65}Ni_{12}Cu_{15-d}Al_8(CCA)_d$ and a size of 2 mm. The manufacturing method is the same as in Experimental Example 5.

A 50% compression strain test of the amorphous alloy specimen was performed at a strain rate of $5*10^{-4}$/s by using a universal material testing machine (Device name: Instron 5967, Manufacturer: Instron), and the results are shown in FIG. 10.

Figure 10:
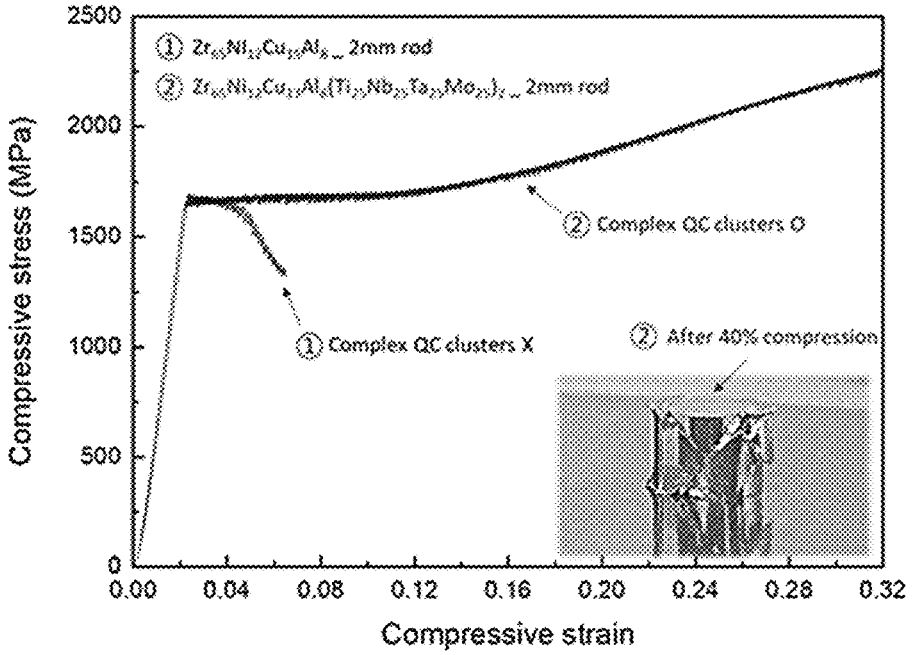
FIG. 10 is a graph of compression test results for 2 mm rod-shaped amorphous alloy specimens wherein in a composition of $Zr_{65}Ni_{12}Cu_{15-d}Al_8(CCA)_d$, CCA is $Ti_{25}Nb_{25}Ta_{25}Mo_{25}$, but a content (d) thereof is 0 atomic % (not added) and 2 atomic %, respectively. The accompanying drawing is a photograph showing the appearance of an amorphous specimen including 2 atomic % of CCA after 40% compression strain.

Referring to FIG. 10, in the $Zr_{65}Ni_{12}Cu_{15-d}Al_8(Ti_{25}Nb_{25}Ta_{25}Mo_{25})_d$ composition, the 2 mm rod-shaped amorphous alloy specimen with a CCA content (d) of 0 atomic % (no addition) exhibited an elongation within 6%.

On the other hand, in the $Zr_{65}Ni_{12}Cu_{15-d}Al_8(CCA)_d$ composition, even though the 2 mm rod-shaped amorphous alloy specimen using $Ti_{25}Nb_{25}Ta_{25}Mo_{25}$ as CCA in the CCA content of (d) of 2 atomic % was compressed, the specimen was not broken but as a pressure according to compression continuously increased, exhibited a superplastic behavior, in which mechanical stability was maximized.

This superplastic behavior was caused by adding the complex concentrated alloy inside the quaternary amorphous alloy matrix with a high Zr content and thus simultaneously maximizing a deviation local composition and a deviation n in structural complexity.

Experimental Example 7: Three-Point Bending Test of an Amorphous Alloy Including CCA Using a Quaternary Amorphous Alloy as a Matrix The composition of the quaternary amorphous alloy matrix was $Zr_{65}Ni_{12}Cu_{15-d}Al_8$, and the composition of CCA was $Ti_{25}Nb_{25}Ta_{25}Mo_{25}$, but the contents thereof was changed as follows to manufacture a rod-shaped amorphous alloy specimen having a composition of $Zr_{65}Ni_{12}Cu_{15-d}Al_8(CCA)_d$ and a size of 2 mm. The manufacturing method is the same as in Experimental Example 5.

Subsequently, the amorphous alloy specimen with a size of 2 mm and a height of 50 mm was thermoplastically molded into a plate shape with a thickness of 1 mm at 420° C. under a pressure of 10 kN.

A universal material test machine (Device name: Instron 5967, Manufacturer: Instron) was used along with a 2810-400 jig to perform a three-point bending test of the amorphous alloy specimen under a span length of 24 mm at a strain rate of 10-4/s, and the results are shown in FIG. 11.

Figure 11:
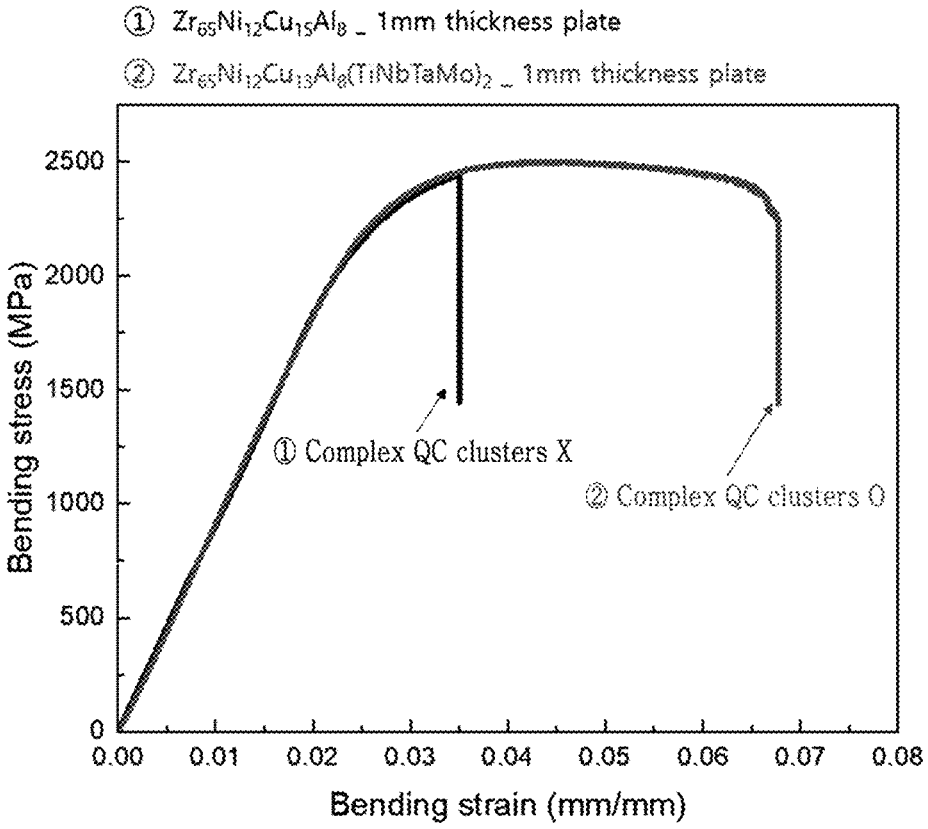
FIG. 11 is a graph of the three-point bending test results for 1 mm thick plate-shaped amorphous alloy specimens wherein in a composition of $Zr_{65}Ni_{12}Cu_{15-d}Al_8(CCA)_d$, CCA is $Ti_{25}Nb_{25}Ta_{25}Mo_{25}$, but a content (d) thereof is 0 atomic % (not added) and 2 atomic %, respectively.

Referring to FIG. 11, the plate-shaped amorphous alloy specimen with the $Zr_{65}Ni_{12}Cu_{15-d}Al_8(Ti_{25}Nb_{25}Ta_{25}Mo_{25})_d$ composition having the CCA content (d) of 0 atomic % (no addition) and the size of 1 mm had a short elongation within 3.5% and was broken.

On the other hand, in the $Zr_{65}Ni_{12}Cu_{15-d}Al_8(CCA)_d$ composition using $Ti_{25}Nb_{25}Ta_{25}Mo_{25}$ as CCA with the CCA content (d) of 2 atomic %, the plate-shaped amorphous alloy specimen with a size of 1 mm had excellent elongation of about 7%. In addition, the specimen was not immediately broken after the maximum stress (Ultimate strength) and exhibited gradually decreased stress in the three-point bending test, which confirmed that structural flexibility and mechanical stability of the amorphous alloy significantly increased.

Experimental Example 8: Thermoplastic Forming and Fracture Toughness Test of an Amorphous Alloy Including CCA Using a Quaternary Amorphous Alloy as a Matrix A plate-shaped amorphous alloy specimen having a composition of $Zr_{65}Ni_{12}Cu_{13}Al_8(Ti_{25}Nb_{25}Ta_{25}Mo_{25})_2$ and a thickness of 1 mm was prepared. A manufacturing method thereof was the same method as used in Experimental Example 7.

The amorphous alloy specimen was thermoplastically molded at 420° C. into a specimen with a size of 25×5×0.3 mm (single edge notched tension (SENT) sample) to measure fracture toughness. Herein, a single edge notch had a notch length=2.5 mm (a/W=0.5) and a notch root radius, p=10 μm, and the fracture toughness was measured at a strain rate of 10-4/s.

Figure 12:
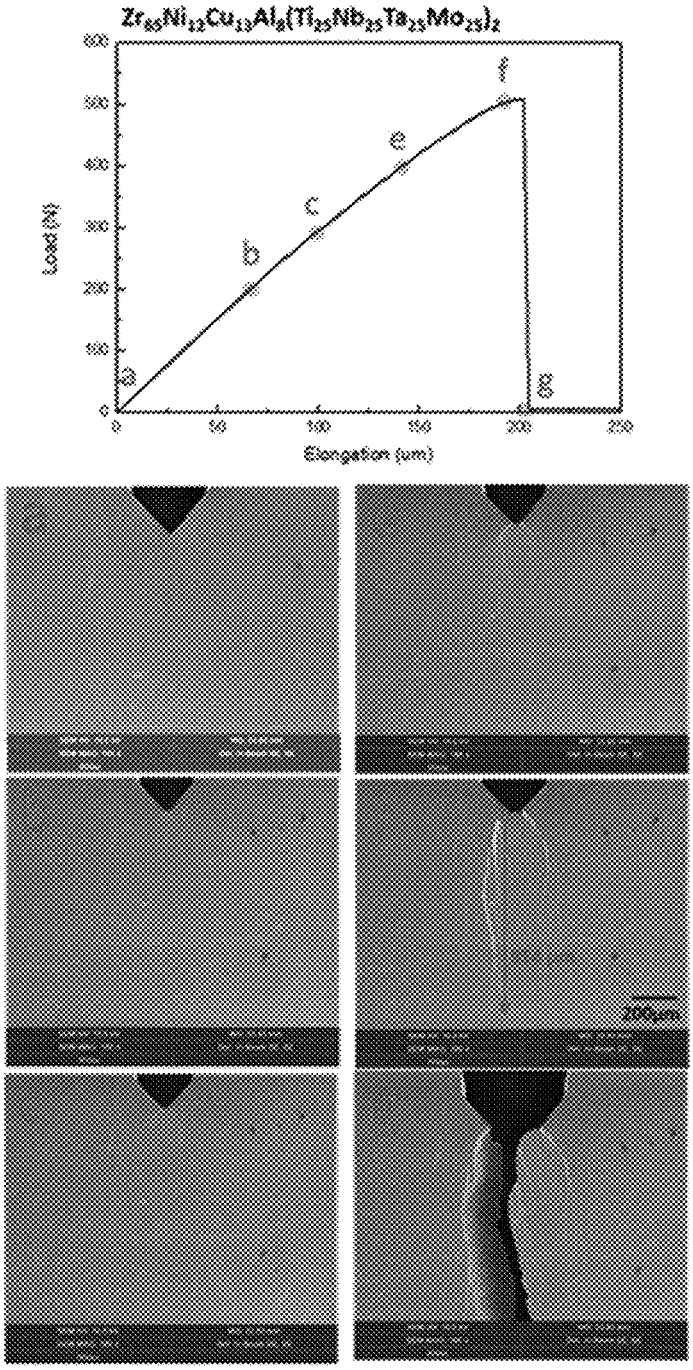
FIG. 12 shows fracture toughness measurement results of the plate-shaped amorphous alloy specimen (top) having a 1 mm-thick single notch (notch length=2.5 mm (a/W=0.5), notch root radius, p=10 μm) manufactured through thermoplastic processing in a composition of $Zr_{65}Ni_{12}Cu_{13}Al_8(Ti_{25}Nb_{25}Ta_{25}Mo_{25})_2$ and scanning electron microscope images (bottom) that can confirm crack propagation behaviors of the notch tip under each loading condition.

Referring to FIG. 12, the alloy fracture toughness specimen having the $Zr_{65}Ni_{12}Cu_{13}Al_8(Ti_{25}Nb_{25}Ta_{25}Mo_{25})_2$ composition had a large plastic zone of about 914 μm and excellent toughness of 100 $MPa \cdot m^{12}$ or more. In addition, in the fracture toughness test, the specimen was not broken immediately after forming shear bands but continuously deformed, as the strain increased, but the shear bands gradually propagated, which confirmed that structural flexibility and mechanical stability of the amorphous alloy significantly increased.

Experimental Example 9: Healing Behavior of Amorphous Alloy Including CCA Using Quaternary Amorphous Alloy as a Matrix A rod-shaped amorphous alloy specimen having a composition of $Zr_{65}Ni_{12}Cu_{13}Al_8(Ti_{25}Nb_{25}Ta_{25}Mo_{25})_2$ and a size of 2 mm was prepared. The manufacturing method is the same as in Experimental Example 5.

Figure 13:
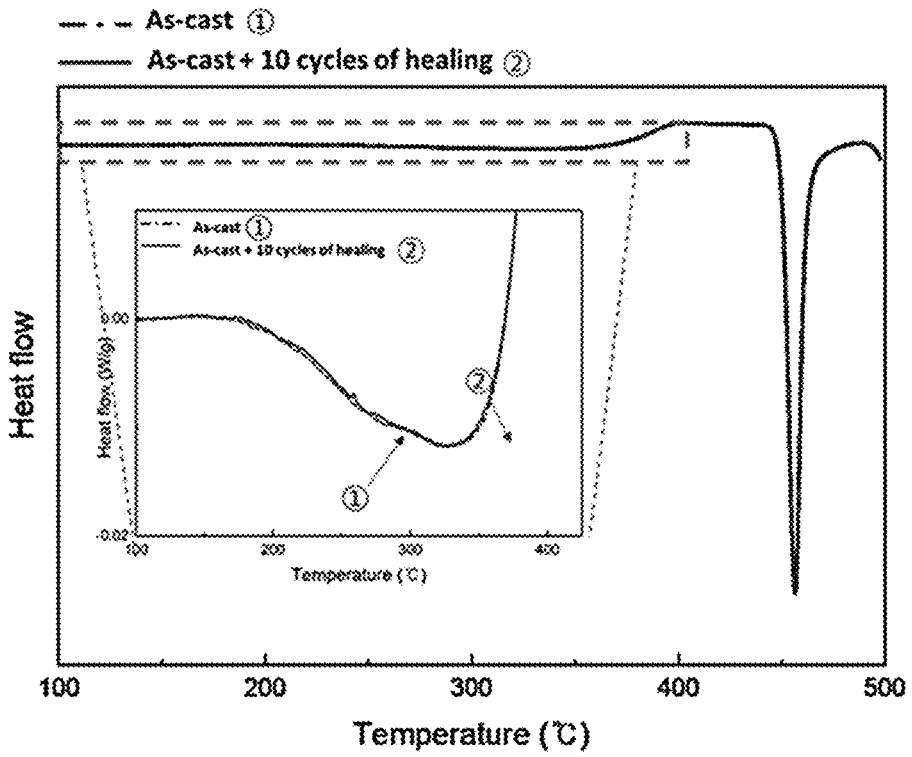
FIG. 13 is graph showing a differential scanning calorimetry and is a drawing showing an enlarged structure relaxation region (inset) for a rod-shaped amorphous alloy specimen having a size of 2 mm in a composition of $Zr_{65}Ni_{12}Cu_{13}Al_8(Ti_{25}Nb_{25}Ta_{25}Mo_{25})_2$ immediately after casting (as-cast) and after 10 cycles of healing after casting, respectively.

Immediately after forming the amorphous alloy specimen and also, after 10 healing cycles after the forming, a differential scanning calorimeter (DSC, DSC 8500, Perkin Elmer) was used for each analysis, and the results are shown in FIG. 13.

The healing cycles were repetitively performed as one thermo-cycling of alternating−50° C. or lower and 100° C. or higher respectively for 20 seconds or more.

Hereinafter, "the analysis immediately after forming the amorphous alloy specimen and also, after 10 healing cycles after the forming by using a differential scanning calorimeter" was performed under the same condition as above.

This heat repetition process may easily provide a complex environment for applying external energy such as (1) thermal energy according to temperature changes, (2) local mechanical energy through repeated expansion-contraction of interatomic bonds, etc.

Referring to FIG. 13, the conventional amorphous alloy exhibited an increase in enthalpy change (ΔH) after the healing cycles, but the rod-shaped amorphous alloy specimen with the composition of $Zr_{65}Ni_{12}Cu_{13}Al_8(Ti_{25}Nb_{25}Ta_{25}Mo_{25})_2$ and a size of 2 mm exhibited an increase in structural flexibility of the amorphous alloy even in the as-cast state.

Specifically, after casting the amorphous alloy specimen, when 10 healing cycles were performed, the specimen exhibited amorphous structure relaxation behaviors, resulting in a similar enthalpy change (ΔH) of an energy region showing a gentle exothermic reaction within a low temperature range below a crystallization temperature.

This means that as a result of adding a complex concentrated alloy to a quaternary amorphous alloy matrix with a high Zr content and thus simultaneously maximizing a deviation in local composition and a deviation in structural complexity, an amorphous structure made through the casting entered a steady-state region.

In addition, the novel amorphous alloy of an embodiment, even though external energy including one selected from a group consisting of mechanical energy, electrical energy, thermal energy, magnetic energy, and a combination thereof at a level corresponding to the heat repetition condition is applied thereto, may exhibit unique self-healing properties of recovering a strain region.

Experimental Example 10: Compression Strain and Healing Behavior of an Amorphous Alloy Including CCA Using a Quaternary Amorphous Alloy as a Matrix A rod-shaped amorphous alloy specimen with a composition of $Zr_{65}Ni_{12}Cu_{13}Al_8(Ti_{25}Nb_{25}Ta_{25}Mo_{25})_2$ and a size of 2 mm was prepared. The manufacturing method was the same as in Experimental Example 5.

Figure 14:
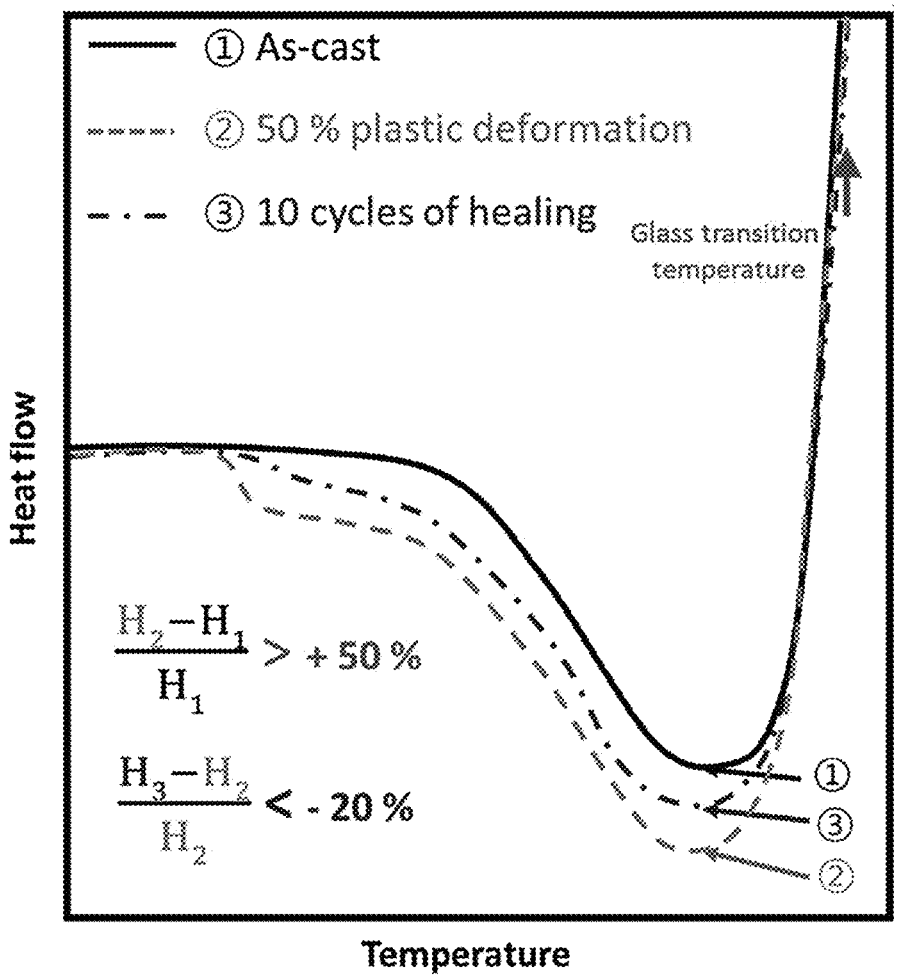
FIG. 14 is graph showing a differential scanning calorimetry for a rod-shaped amorphous alloy specimen having a size of 2 mm in a composition of $Zr_{65}Ni_{12}Cu_{13}Al_8(Ti_{25}Nb_{25}Ta_{25}Mo_{25})_2$, immediately after casting (as-cast), after 50% compression strain, and 10 cycles of healing after 50% compression strain.

The amorphous alloy specimen, after performing a 50% compression strain test and then, ten healing cycles, was analyzed by using a differential scanning calorimeter (DSC, DSC 8500, Perkin Elmer), and the results are shown in FIG. 14. Herein, the 50% compression strain test was performed under the same conditions as in Experimental Example 6, and the healing cycles were performed under the same condition as in Experimental Example 8.

In FIG. 14, the rod-shaped amorphous alloy specimen with a composition of $Zr_{65}Ni_{12}Cu_{13}Al_8(Ti_{25}Nb_{25}Ta_{25}Mo_{25})_2$ and a size of 2 mm was five times and more analyzed through the differential scanning calorimetry immediately after the 50% compression strain test and also, after the 10 healing cycles after the 50% compression strain test, respectively, which were calculated into each average change.

The rod-shaped amorphous alloy specimen with the composition of $Zr_{65}Ni_{12}Cu_{13}Al_8(Ti_{25}Nb_{25}Ta_{25}Mo_{25})_2$ and a size of 2 mm exhibited that a plurality of shear bands were formed in the differential scanning calorimetry immediately after the 50% compression strain and thus had at least about 50% increased enthalpy value (ΔH) of the amorphous structure relaxation behaviors, compared with that immediately after the casting.

Furthermore, the rod-shaped amorphous alloy specimen with the composition of $Zr_{65}Ni_{12}Cu_{13}Al_8(Ti_{25}Nb_{25}Ta_{25}Mo_{25})_2$ and a size of 2 mm exhibited uniquely about 20% or more reduced enthalpy value of the amorphous structure behaviors through the ten healing cycles after the 50% compression strain, which confirmed that not only structural recovery (rejuvenation) but also healing for permanent strain effectively occurred.

This healing behavior for permanent strain was caused by adding the complex concentrated alloy to the quaternary amorphous alloy matrix with a high Zr content and thus simultaneously maximizing the deviation in local composition and the deviation in structural complexity. Specifically, the complex quasicrystal clusters were formed in the quaternary amorphous alloy matrix, wherein when external energy was applied thereto, as interatomic bonds repeatedly expanded and contracted, the complex quasicrystal clusters turned out to serve as a healing core unit.

Experimental Example 11: Fatigue Damage Healing Behavior of Amorphous Alloy Including CCA Using Quaternary Amorphous Alloy as a Matrix A ribbon amorphous alloy specimen having a composition of $Zr_{65}Ni_{12}Cu_{13}Al_8(Ti_{25}Nb_{25}Ta_{25}Mo_{25})_2$ and a size of 10 μm was manufactured.

Specifically, a CCA raw material mixture with a $Ti_{25}Nb_{25}Ta_{25}Mo_{25}$ composition was prepared and then, melted at 3500° C. for 10 minutes, preparing a CCA molten metal. The CCA molten metal was cooled at 10° C./s for 10 minutes or less, obtaining a CCA specimen.

Subsequently, Zr, Ni, Cu, and Al were added to the CCA specimen in consideration of a stoichiometric atomic ratio of $Zr_{65}Ni_{12}Cu_{15-d}Al_8$, the $Zr_{65}Ni_{12}Cu_{15-d}Al_8$ and CCA raw material mixture was melted at 3000° C. for 10 minutes, preparing a molten metal of the $Zr_{65}Ni_{12}Cu_{15-d}Al_8(CCA)_d$ composition.

Then, the molten metal was cooled at $10^{6\circ}$ C./s for 1 second or less and formed into a 10 μm ribbon-shape, obtaining amorphous alloy specimens.

Figure 15:
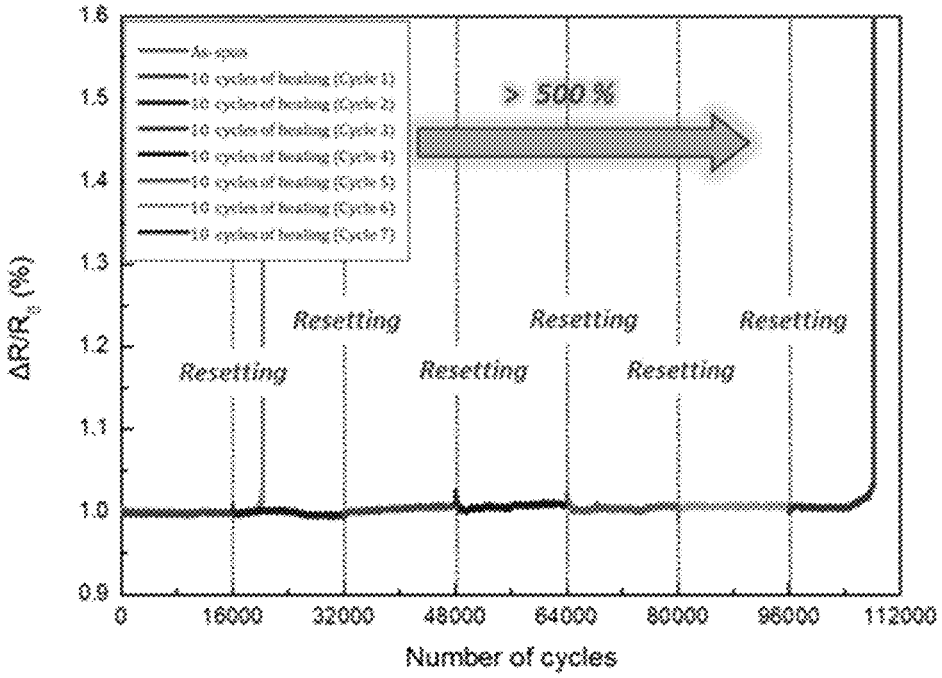
FIG. 15 shows the results of the fatigue test for a 10 μm-thick ribbon amorphous alloy specimen, in a composition of $Zr_{65}Ni_{12}Cu_{13}Al_8(Ti_{25}Nb_{25}Ta_{25}Mo_{25})_2$, wherein the specimen (as-spun) has not undergone the healing cycle recovery treatment and the specimen has undergone 10 healing cycle recovery treatment after 80% strain of the maximum fatigue strain.

FIG. 15 shows the results of a fatigue test for the 10 μm-thick ribbon amorphous alloy specimens with the composition of $Zr_{65}Ni_{12}Cu_{13}Al_8(Ti_{25}Nb_{25}Ta_{25}Mo_{25})_2$, which were subjected to no healing cycle recovery treatment (as-spun) and to 10 healing cycle recovery treatment after 80% strain of the maximum fatigue strain. The drawing shows that resistance of the material changes according to the number of fatigue failure cycles. Herein, the material resistance sharply increases, when defects become larger and develop into fatigue cracks, and the cracks gradually propagate. As shown in the drawing, the as-spun specimen was finally fractured, after receiving about 20,000 cycles of fatigue stress. In particular, at about 18,000 cycles (=90% of fracture cycles) or more, the resistance greatly increased through sharp increase of the internal defects. The corresponding alloy was subjected to the fatigue stress to 16,000 cycles, which is 80% of the number of the fracture cycles (red dotted line), and then, to 10 healing cycles. When the amorphous alloy developed in this way was repeatedly recovery-treated, 100,000 cycles or more were repeatable beyond the original material life-span of 20,000 cycles. Therefore, it was confirmed that the repeated performance of the healing cycles of the present invention effectively removed the fatigue strain region generated in the material and thereby extended its life-span.

While this invention has been described in connection with what is presently considered to be practical example embodiments, it is to be understood that the invention is not limited to the disclosed embodiments. On the contrary, it is intended to cover various modifications and equivalent arrangements included within the spirit and scope of the appended claims.

What is claimed is:

1. An amorphous alloy, comprising a quaternary amorphous alloy matrix including Zr, Ni, Cu, and Al; and a complex concentrated alloy (CCA) dispersed inside the quaternary amorphous alloy matrix, wherein, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance, the complex concentrated alloy has a single-phase body-centered cubic (BCC) structure, the entire composition of the amorphous alloy is represented by Chemical Formula 1:

$$Zr_aNi_bCu_{c-d}Al_f(X)_d \quad \text{[Chemical Formula 1]}$$

wherein, in Chemical Formula 1, X includes two or more elements selected from Ti, Zr, Hf, V, Nb, Ta, and Mo, b is 2 to 29, (c-d) is 2 to 29, d is 1 to 10, f is 6 to 18, and a is 100−(b+c+f), and X in Chemical Formula 1 satisfies Equation 1:

$$10.0 \leq \{(1/3)*(x+n+o+p)+(1/6.9)*y+(1/7)*(z+m)\} \quad \text{[Equation 1]}$$

wherein x, y, z, m, n, o, and p are atomic fractions of Ti, Zr, Hf, V, Nb, Ta, and Mo in Chemical Formula 1, respectively.

2. The amorphous alloy of claim 1, wherein the complex quasicrystal cluster includes a plurality of quasicrystal nuclei (QC) and a free volume region in which the quasicrystal nuclei do not exist;

each of the quasicrystal nuclei includes a plurality of principal clusters and an adhesive element (glue atom) for adhering the plurality of principal clusters, and the principal cluster includes Zr and Ni among elements constituting the quaternary amorphous alloy matrix.

3. The amorphous alloy of claim 2, wherein each principal cluster includes Zr and Ni in an atomic ratio of about 1:1 to about 3:1.

4. The amorphous alloy of claim 2, wherein the principal cluster has an icosahedral structure;

for each principal cluster, nine Zr's and three Ni's form a basic framework of the icosahedral structure, and one Ni is disposed at a center of the basic framework of the icosahedral structure.

5. The amorphous alloy of claim 2, wherein the adhesive element (glue atom) includes at least one element of elements constituting the complex concentrated alloy.

6. The amorphous alloy of claim 1, wherein

X in Chemical Formula 1 satisfies Equation 1:

$$10.0 \leq \{(1/3)*(x+n+o+p)+(1/6.9)*y+(1/7)*(z+m)\} \quad \text{[Equation 1]}$$

wherein, in Equation 1, x is an atomic fraction of Ti in Chemical Formula 1;

y is an atomic fraction of Zr in Chemical Formula 1;

z is an atomic fraction of Hf in Chemical Formula 1;

m is an atomic fraction of V in Chemical Formula 1;

n is an atomic fraction of Nb in Chemical Formula 1;

o is an atomic fraction of Ta in Chemical Formula 1; and p is an atomic fraction of Mo in Chemical Formula 1.

7. The amorphous alloy of claim 1, wherein a supercooled liquid region of the amorphous alloy is greater than or equal to about 20 K.

8. The amorphous alloy of claim 1, wherein the amorphous alloy has an elongation rate of greater than or equal to about 5% during a three-point bending test on a plate-shaped specimen having a thickness of 1 mm.

9. The amorphous alloy of claim 1, wherein the amorphous alloy has a fracture rate of 0% when a compression test is performed on a specimen having an aspect ratio of greater than or equal to about 1 and less than or equal to about 3.5 until the aspect ratio is 1.

10. The amorphous alloy of claim 1, wherein the amorphous alloy has a fracture toughness of greater than or equal to about 100 $MPa \cdot m^{1/2}$ in a fracture test on a specimen having a thickness of 0.01 to 20.0 mm.

11. The amorphous alloy of claim 1, wherein the amorphous alloy has more than twice increased fatigue life-span after continuously performing a fatigue test and 10 heat repetition processes within the elastic range for a specimen having a size of 0.01 to 20.0 mm.

12. The amorphous alloy of claim 1, wherein the amorphous alloy has a reduction rate of an enthalpy value of greater than or equal to about 20% after 10 thermal strain cycles on a rod-shaped specimen having a size of 2 mm, when alternately performing an environment of less than or equal to about −50° C. and an environment of greater than or equal to about 100° C. for 20 seconds or longer, respectively, as one thermal strain cycle.

13. The amorphous alloy of claim 1, wherein the amorphous alloy is produced by cooling a molten metal including the first alloying elements and the second alloying elements, a critical cooling rate is greater than or equal to about $10^0$ K/s and less than or equal to about $10^6$ K/s during cooling of the molten metal, and a thickness is greater than or equal to about 10 μm and less than or equal to about 20 mm.

14. A product comprising the amorphous alloy of claim 1.

15. The product of claim 14, wherein the product is a sporting goods, a medical device, a gear of a watch, an interior material of an electronic device, an exterior material of an electronic device, or a driving unit of a smart robot.

16. A method of manufacturing an amorphous alloy, comprising:

a first process of preparing a complex concentrated alloy (CCA) having a single-phase body-centered cubic (BCC) structure and including two or more elements selected from Ti, Zr, Hf, V, Nb, Ta, and Mo;

a second process of preparing a mixture by mixing Zr, Ni, Cu, and Al with the complex concentrated alloy so that the entire composition is represented by Chemical Formula 1:

$$Zr_aNi_bCu_{c-d}Al_f(X)_d$$

and satisfies Equation 1:

$$10.0 \leq \{(1/3)*(x+n+o+p)+(1/6.9)*y+(1/7)*(z+m)\}$$

wherein X includes the two or more elements, b is 2 to 29, (c-d) is 2 to 29, d is 1 to 10, f is 6 to 18, a is 100−(b+c+f), and x, y, z, m, n, o, p are atomic fractions of Ti, Zr, Hf, V, Nb, Ta, Mo, respectively;

a third process of melting the mixture to produce molten metal; and a fourth process of cooling the molten metal obtain an amorphous alloy, wherein among a total amount, 100 atomic % of the Zr, Ni, Cu, and Al, based on a total amount of 100 atomic % of the quaternary amorphous alloy matrix, the Ni is included in about 2 to about 29 atomic %, the Cu is included in about 2 to about 29 atomic %, the Al is included in about 6 to about 18 atomic %, and the Zr is included as a balance.

17. The method of claim 16, wherein in the fourth process, the critical cooling rate is greater than or equal to about $10^0$ K/s and less than or equal to about $10^6$ K/s.

18. The method of claim 17, wherein in the fourth process, the thickness of the molten metal is greater than or equal to about 10 μm and less than or equal to about 20 mm.

* * * * *